United States Patent [19]

Baker

[11] 4,105,069

[45] Aug. 8, 1978

[54] GRAVEL PACK LINER ASSEMBLY AND SELECTIVE OPENING SLEEVE POSITIONER ASSEMBLY FOR USE THEREWITH

[75] Inventor: Eugene E. Baker, Duncan, Okla.

[73] Assignee: Halliburton Company, Duncan, Okla.

[21] Appl. No.: 805,075

[22] Filed: Jun. 9, 1977

[51] Int. Cl.[2] ..... E21B 33/13; E21B 43/10

[52] U.S. Cl. ..... 166/51; 166/332; 166/289

[58] Field of Search ..... 166/51, 332, 289, 154, 166/191

[56] References Cited

U.S. PATENT DOCUMENTS

| | | | |
|---|---|---|---|
| 3,153,451 | 10/1964 | Chancellor et al. | 166/51 |
| 3,335,802 | 8/1967 | Seyffert | 166/214 |
| 3,606,926 | 9/1971 | Schwegman | 166/154 |
| 3,637,010 | 1/1972 | Maly et al. | 166/51 |
| 3,698,477 | 10/1972 | Radig et al. | 166/214 |
| 3,768,562 | 10/1973 | Baker | 166/289 |
| 3,845,815 | 11/1974 | Garwood | 166/154 |
| 3,856,082 | 12/1974 | Dinning | 166/154 |
| 3,948,322 | 4/1976 | Baker | 166/289 |

*Primary Examiner*—Ernest R. Purser

*Attorney, Agent, or Firm*—John H. Tregoning; James R. Duzan

[57] ABSTRACT

An improved liner assembly for open hole, multi-zone gravel pack completions employing full opening gravel and cementing collars and full opening inflatable packers. The valve mechanism of each full opening collar and full opening packer comprises an inner valve sleeve operated solely by vertical reciprocation by a drill string received therein and carrying an improved selective opening sleeve positioner assembly on the lower end thereof. A method of gravel packing and cementing utilizing the improved liner assembly and selective opening sleeve positioner assembly is also disclosed.

10 Claims, 24 Drawing Figures

GRAVEL PACK LINER ASSEMBLY AND SELECTIVE OPENING SLEEVE POSITIONER ASSEMBLY FOR USE THEREWITH

This invention relates generally to oil well completions, and more particularly, but not by way of limitation, to methods and apparatus for achieving open hole, multi-zone, gravel pack completions of oil wells.

In the completion of oil wells, it is often desirable to apply one or more gravel packs in the annulus between a liner assembly and a well bore adjacent one or more producing intervals. The annular spaces between the liner assembly and the wall bore intermediate the producing intervals are customarily cemented. In order to isolate the producing intervals from the portions of the annulus between the liner assembly and the well bore which are to be cemented, packers are ordinarily employed, especially in open hole completions.

The prior art technique for achieving open hole, multizone gravel pack completions utilizes a liner assembly equipped with a plurality of rotationally actuated gravel pack or cementing port collars as well as inflatable packer mechanisms which are inflated through check valves located at the lower end of the packer inflatable member. It is necessary in the prior art liner assemblies for the port collar valves to be positioned in the open position when the liner assembly is run into the well bore and hung.

It has been found that rotationally actuated port collars can sometimes be difficult to operate since the magnitude of rotational force which can be applied thereto through rotation of the drill string is somewhat limited. Further, rotationally actuated valves generally provide very little indication at the ground surface as to the state of the valve during its actuation, thus providing uncertainty to the operator as to whether or not a valve is fully open or fully closed at any particular time.

It should also be noted that the employment of port collar valve mechanisms which must be placed in an open position during running in of a liner assembly presents certain difficulties. It will be readily apparent that a liner assembly having its port collar in the open position is not susceptible to being floated into a well bore. This can be a substantial disadvantage in an extremely deep well. MOre significantly, however, is the fact that a liner assembly having open port collars provides a distinct safety hazard when the liner assembly is being installed in a well having one or more high pressure zones being contained by a mud column. Since the liner assembly must be run into the well with its upper end open, open port collars prevent effective blowout prevention control in such high pressure environments.

It should be further noted that inflatable packers which are inflated past check valves located at the lower end portion of an inflatable element are susceptible to being collapsed by the hydrostatic pressure applied thereto by the column of cement or other fluid supported above the packer when it is inflated. In the event of a malfunction of the check valve mechanism in such a packer, the hydrostatic pressure applied by the column supported by the packer can force the inflation fluid from the packer thereby deflating the packer and unseating it from the wall of the well bore.

It is, therefore, advantageous to employ a liner assembly wherein the prot collars can be actuated by vertical manipulation of the drill string and can be placed in the closed position when the liner assembly is run into the well bore. Further, it is advantageous to employ inflatable packers which are inflated past check valves located at the upper end of the inflatable element thereof and which employ the hydrostatic pressure of the cement or fluid column supported by the inflated packer to augment the pressure of the inflation fluid within the inflatable element.

DESCRIPTION OF A PREFERRED EMBODIMENT

Figure 1A:
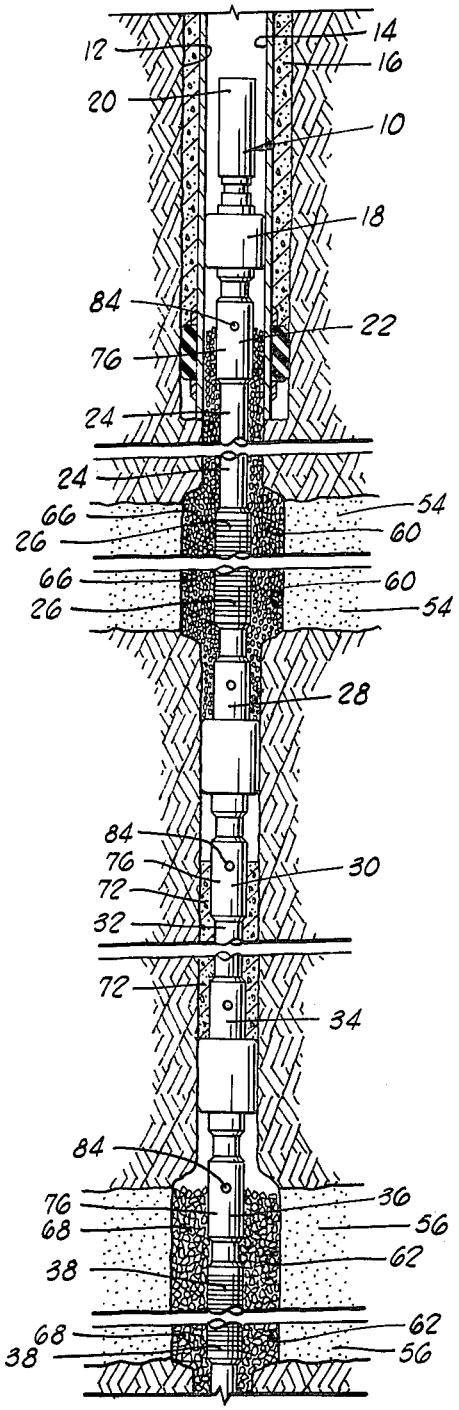
FIGS. 1A and 1B provide a schematic diagram of an open hole, multi-zone gravel pack completion in a well.
Figure 1B:
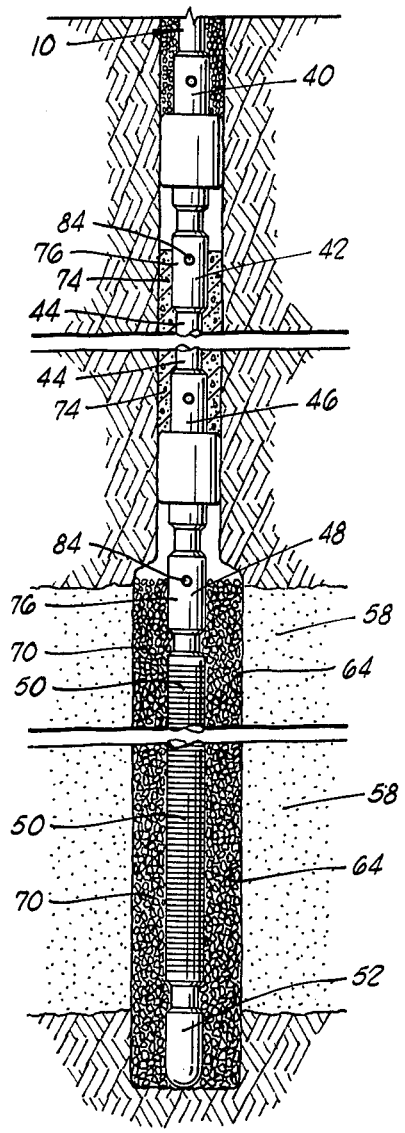

Referring now to the drawings, and to FIGS. 1A and 1B in particular, an open hole, multi-zone gravel pack completion in a well is illustrated therein in accordance with the present invention. The production tubing string or liner assembly is generally designated by the reference character 10. The liner assembly 10 is disposed within a well bore 12, the upper portion of which has been cased and cememted as shown at 14 and 16, respectively. The liner assembly 10 is secured within the casing 14 at the upper end thereof by means of a suitable liner hanger casing packer 18 which is expanded into sealing engagement with the casing 14. Extending upwardly from the packer 18 is a conventional liner running tool 20 by which the liner assembly 10 was secured to a drill string during its installation within the well bore 12.

Moving downwardly from the packer 18, the liner assembly 10 comprises a full opening gravel collar 22, a length of tubular liner 24, a length of perforated or slotted tubing 26, a full opening gravel packer 28, a full opening cementing collar 30, a second length of tubular liner 32, a full opening cementing packer 34, a second full opening gravel collar 36, a second length of perforated or slotted tubing 38, a second full opening gravel packer 40, a second full opening cementing collar 42, a third length of tubular liner 44, a second full opening cementing packer 46, a third full opening gravel collar 48, and a third length of perforated or slotted tubing 50, with the liner assembly 10 terminating with a suitable shoe such as a float shoe 52 at the lower end thereof.

The well bore 12 penetrates first, second and third producing intervals, 54, 56 and 58, respectively. The lengths of perforated tubing, 26, 38 and 50 are selected so as to correspond in length to the height of the respective producing intervals 54, 56 and 58 and are so spaced on the liner assembly 10 as to be vertically aligned with the respective producing intervals as illustrated in FIGS. 1A and 1B. The well bore 12 is enlarged along the penetrated producing intervals 54, 56 and 58 by suitable means, such as underreaming, as shown at 60, 62 and 64 as shown in FIGS. 1A and 1B.

The underreamed portions 60, 62 and 64 of the well bore 12 are packed with gravel as shown at 66, 68 and 70, respectively, while the portions of the liner assembly 10 adjacent the lengths of tubular liner 32 and 44 are cemented within the well bore 12 as shown at 72 and 74.

Figure 4:
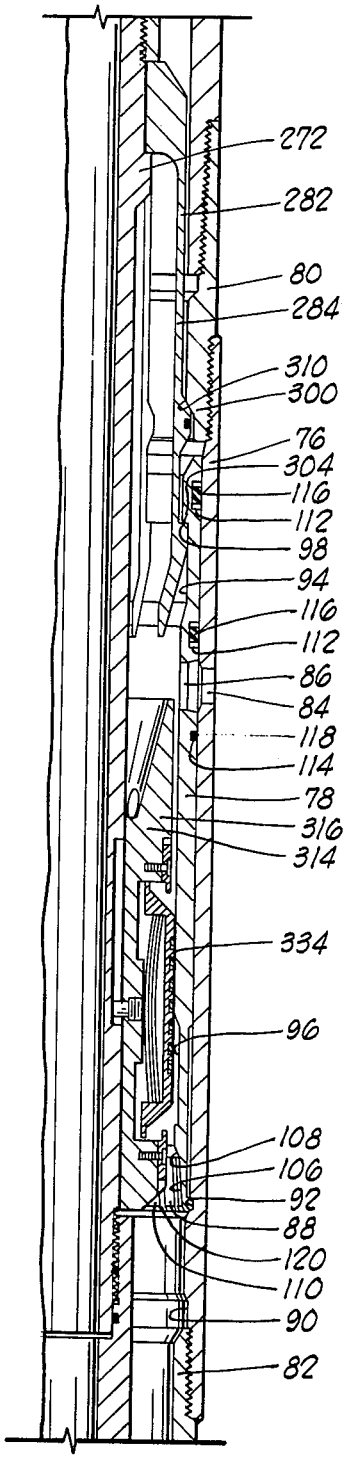
FIG. 4 is a partial vertical cross-sectional view of the collar of FIG. 3 engaged with the selective opening sleeve positioner assembly showing the valve mechanism in the open position.

The full opening gravel collars 22, 36 and 48 and the full opening cementing collars 30 and 42 are identical in construction, and are substantially identical to the cementing tool illustrated in FIG. 1 of U.S. Pat. No. 3,768,562, issued to Eugene E. Baker, and assigned to Halliburton Company, the assignee of the present invention. U.S. Pat. No. 3,768,562 is incorporated herein by reference. Each of the full opening collars 22, 30, 36, 42 and 48 comprises an outer cylindrical housing 76, an inner valve sleeve 78 telescopically mounted within the housing 76, and upper and lower bodies 80 and 82. The housing 76 has one or more cement or gravel ports 84 extending through the wall thereof in the area where the valve sleeve 78 is slidably located. The valve sleeve 78 is provided with matching cement or gravel ports 86 extending through the wall thereof and arranged to align with the ports 84 when the valve sleeve 78 is in its uppermost or open position within the housing 76 as shown in FIG. 4.

Collet fingers 88 are formed about the circumference of the lower end of the valve sleeve 78 and are adapted to be selectively received in either of two annular grooves or recesses 90 and 92 formed in the inner wall of the housing 76. When the collet fingers 88 are engaged in the annular groove 90, the ports 84 and 86 are out of registration placing the collar in the closed position. When the collet fingers 88 are engaged in the annular groove 92, the valve sleeve 78 is positioned within the housing 76 with the ports 84 and 86 in registration thus placing the collar in the open position. In a preferred embodiment, the collet fingers 88 engage the respective grooves 90 and 92 with sufficient force to require the application of approximately 20,000 pounds of force on the valve sleeve 78 to move it from the closed position to the open position and vice versa.

The valve sleeve 78 is further provided with inner annular recesses 94 and 96 for engagement with respective opening and closing positioners which will be described in detail hereinafter. Recess 94 has a radial shoulder 98 and a tapered shoulder 100, and, similarly, recess 96 has a radial shoulder 102 and a tapered shoulder 104. The valve sleeve 78 also has an annular enlargement 106 at its lower end comprising an outwardly tapered shoulder 108 and a skirt 110.

Annular recesses 112 and 114 are formed in the outer surface of the valve sleeve 78 and carry seal rings 116 and 118, respectively, which sealingly contact the housing 76 and prevent fluid passage thereby between the housing and the valve sleeve.

Figure 7:
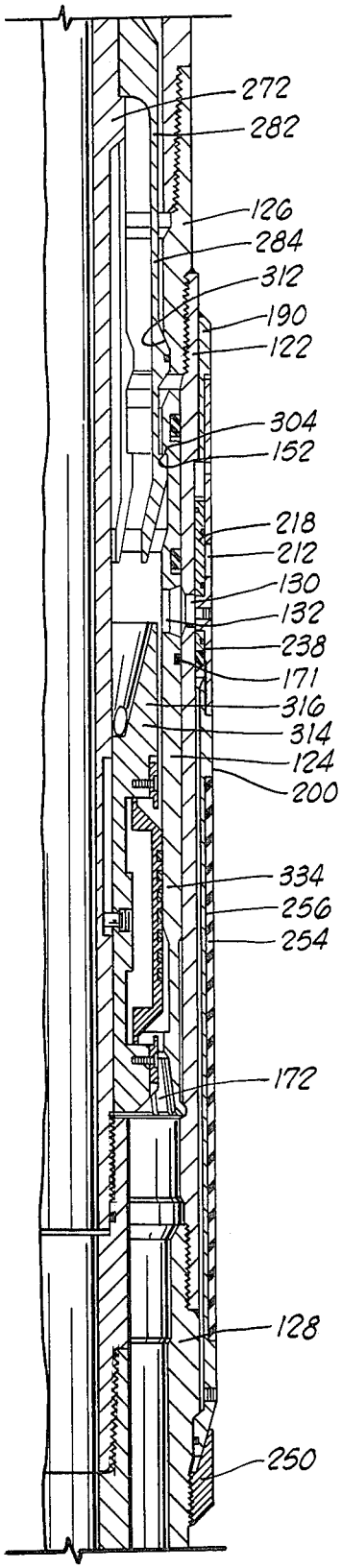
FIG. 7 is a partial vertical cross-sectional view of the packer of FIG. 6 engaged with the selective opening sleeve positioner showing the valve mechanism in the open position.
Figure 8:
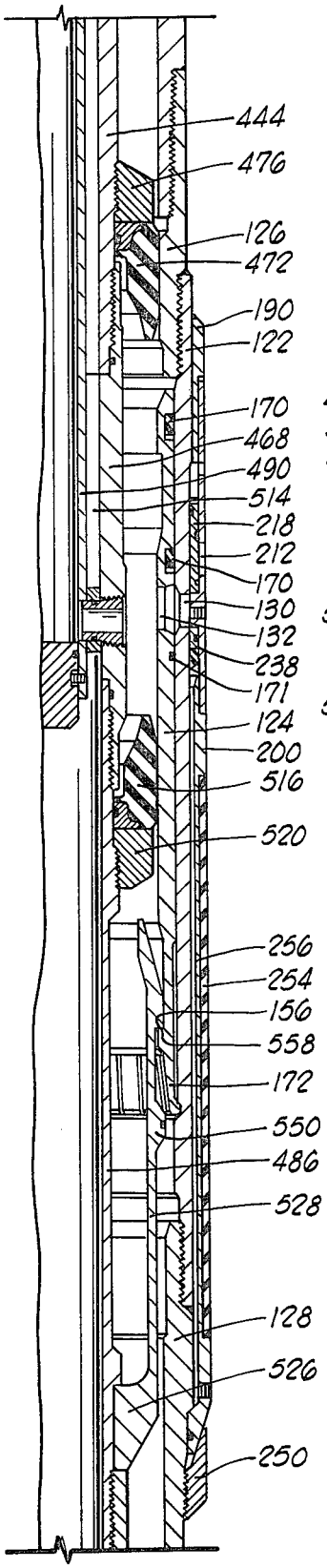
FIG. 8 is a partial vertical cross-sectional view of the packer of FIG. 6 engaged with the selective opening sleeve positioner assembly showing the valve mechanism in the open position ready to pump inflation fluid or cement.
Figure 9:
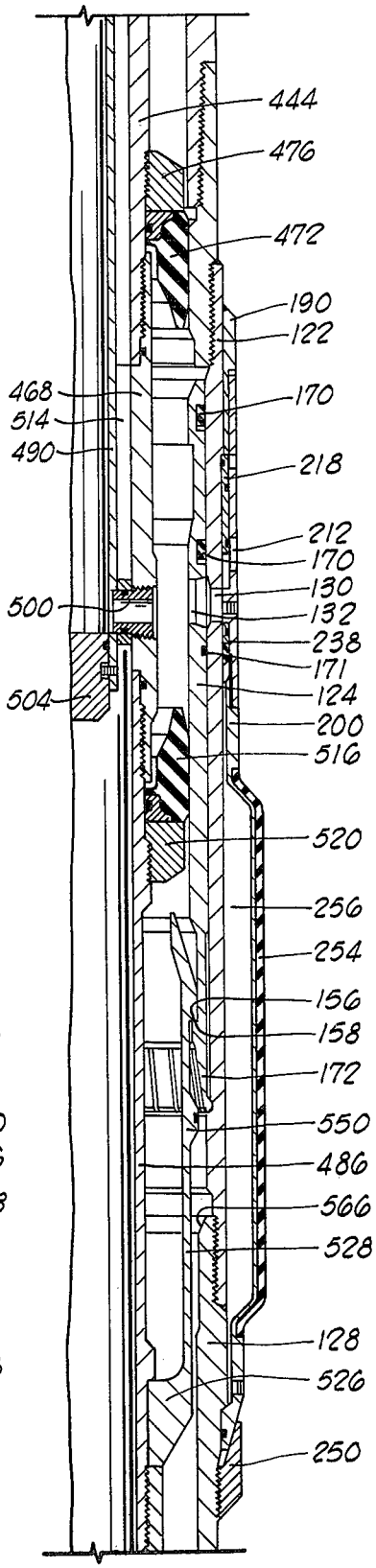
FIG. 9 is a partial vertical cross-sectional view of the packer of FIG. 6 engaged with the selective opening sleeve positioner assembly showing the valve mechanism in the open pumping position with the packer fully inflated and with the pressure release valve tripped.
Figure 10:
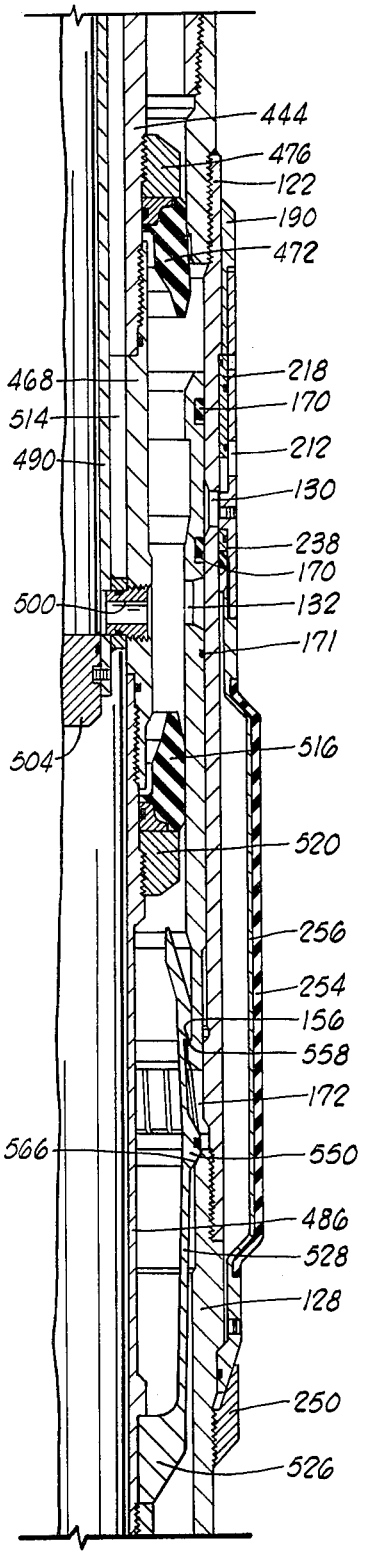
FIG. 10 is a partial vertical cross-sectional view of the packer of FIG. 6 engaged with the selective opening sleeve positioner assembly showing the packer fully inflated with the valve mechanism in the closed position.

The previously mentioned collet fingers 88 may be suitably formed about the bottom circumference of the valve sleeve 78 by machining circumferentially spaced, longitudinal slots in the skirt 110. This provides a spring clip effect on the skirt 110 through the inherent resilience of each collet finger 88. The full opening gravel packers 28 and 40 and the full opening cementing packers 34 and 46 are also identical in construction, and are substantially identical to the inflation packer illustrated in FIG. 8 of U.S. Pat. No. 3,948,322 issued to Eugene E. Baker, and assigned to Halliburton Company, the assignee of the present invention. U.S. Pat. No. 3,948,322 is incorporated herein by reference. Each of the full opening packers 28, 34, 40 and 46 comprises a tubular outer case or housing 122, an inner valve sleeve 124 telescopically disposed within the outer case 122, an upper body member 126 and a lower body member 128. The outer case or housing 122 includes one or more ports 130 extending through the wall thereof in the area where the valve sleeve 124 is slidably located. The valve sleeve 124 includes matching ports 132 extending through the wall thereof and arranged so that the ports 132 will align with the ports 130 when the valve sleeve 124 is in its uppermost or open position within the outer case 122 as shown in FIGS. 7, 8 and 9.

The tubular outer case 122 and the valve sleeve 124 possess appropriately sized inner and outer diameters so that the valve sleeve 124 fits just loosely enough within the outer case 122 to allow it to slide therein. The valve sleeve 124 has substantially the same inner diameter as that of the standard liner of the liner assembly 10 to which the full opening packer is to be secured.

The tubular outer case 122 may be fixedly secured in fluid-tight communication to the upper and lower body members 126 and 128 by means of threaded connections 134 and 136, respectively, and continuous annular welds 138 and 140, respectively.

The outer case 122 includes a radially inwardly extending, cylindrically shaped inner surface 142 communicating at its upper and lower end portions with tapered annular shoulders 144 and 146 respectively.

The valve sleeve 124 is provided with upper and lower inner annular recesses 148 and 140, respectively, for engagement with the opening and closing positioners, respectively, which will be described in detail hereinafter. The upper recess 148 includes a radia shoulder 152 and a tapered shoulder 154 and, similarly, the lower recess 150 includes a radial shoulder 156 and a tapered shoulder 158. The valve sleeve 124 also includes an annular enlargement 160 at its lower end comprising a radially outwardly extending tapered annular shoulder 162 and a skirt 164.

Annular grooves 166 and 168 are formed in the cylindrical outer surface of the valve sleeve 124, each groove 166 carrying an annular seal member 170 and the annular groove 168 carrying an annular seal member 171, which seal members provide sliding fluid-tight seal between the valve sleeve 124 and the cylindrical inner surface of the outer case 122.

Figure 6:
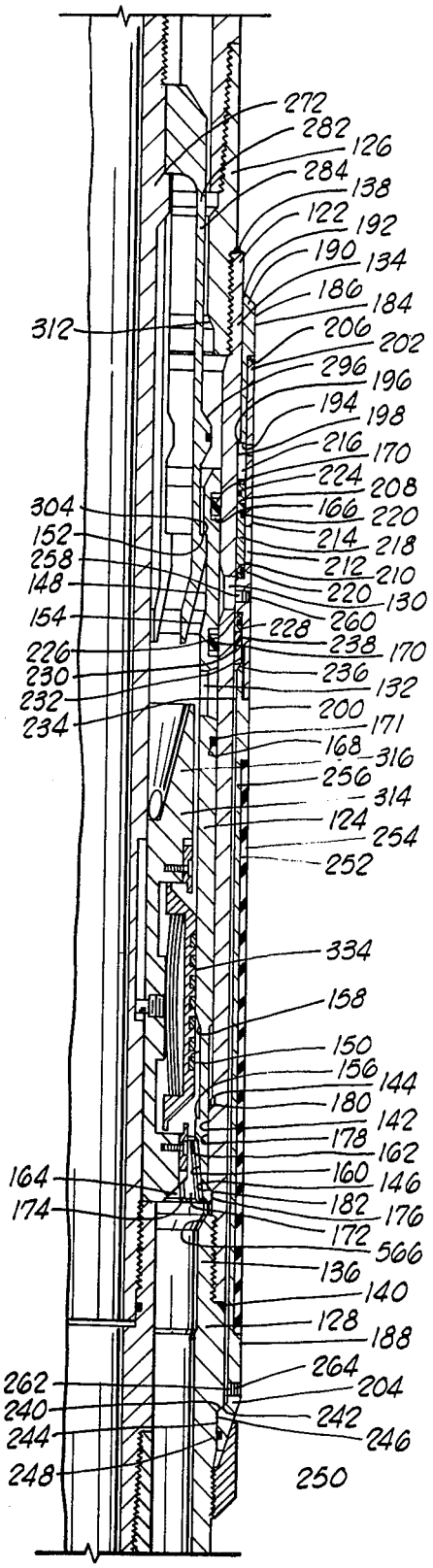
FIG. 6 is a partial vertical cross-sectional view of a full opening grabel or cementing packer engaged with the selective opening sleeve positioner assembly showing the valve mechanism in the closed position.

Collet fingers 172 are formed about the lower circumference of the valve sleeve 124 by machining circumferentially equally spaced slots 174 longitudinally aligned in the skirt 164 of the valve sleeve. This provides a spring clip structure on the skirt 164 through the inherent resilience of each collet finger 172. A radially outwardly extending annular ridge 176 is formed on the skirt 164 and on each collet finger 172. The outer case 122 includes a radially inwardly extending, cylindrically shaped inner surface 178 communicating at its upper and lower end portions with tapered annular shoulders 180 and 182, respectively. The ridge 176 abuts the tapered annular shoulder 182 to prevent premature opening of the apparatus which could otherwise occur through inadvertent movement of the valve sleeve 124 upwardly within the outer case 122. This abutment is best shown in FIG. 6.

The spring force maintaining the valve sleeve 124 in the lowermost position within the outer case 122 can be varied by adjusting the spring tension of the collet fingers 172. This may be done by machining larger or smaller slots 174 in the skirt 164 or, by making the collet fingers 172 thicker or thinner by changing the machined size of the annular enlargement 160. Thus, the valve sleeve 124 can be prevented from sliding until a preset or predetermined force is applied to the sleeve 124, which force will overcome the spring tension in the collet fingers 172. A typical and preferred opening tension for use in the employment of the full opening packers 28, 34, 40 and 46 is approximately 20,000 pounds force. Conversely, when the packer of the present invention is in the fully open position with the valve sleeve 124 in its uppermost position within the outer case 122, aligning ports 130 and 132, the same force required to overcome the tension of the collet fingers 172 to move the valve sleeve 124 upwardly from its closed position will be required to move it downwardly from its open position.

The full opening inflation packers 28, 34, 40 and 46 each additionally include a tubular inflation packer assembly 184, having an upper end portion 186 and a lower end portion 188, which is disposed about the tubular outer case of housing 122. The inflation packer assembly 184 includes a backup ring 190 at the upper end portion 186 thereof. The backup ring 190 is secured to the cylindrical outer surface of tthe outer case 122 by suitable means such as a continuous annular weld as shown at 192. The lower end face 194 of the backup ring 190 extends radially outwardly from a corresponding annular shoulder 196 formed on the housing 122 and communicating with a cylindrical outer surface 198 formed on the housing 122.

The inflation packer assembly 184 further includes a tubular inflatable packer unit 200 disposed about the outer case 122. The packer unit 200 includes an upper end portion 202 and a lower end portion 204. The upper end portion 202 of the packer unit 200 abuts a downwardly facing radial shoulder 206 formed on the backup ring 190. A cylindrical inner surface 208 extends upwardly from an annular shoulder 210 extending radially inwardly from the interior of the packer unit 200 and is positioned longitudinally adjacent the ports 130 formed in the wall of the case 122. At least one, and preferably two or more ports 212 are formed in the upper end portion 202 of the packer unit 200 and communicate between the cylindrical inner surface 208 and the cylindrical outer surface 214 thereof.

The cylindrical outer surface 198 and annular shoulder 196 of the outer case 122, the lower end face 194 of the backup ring 190 and the cylindrical inner surface 208 of the packer unit 200 define an annular cavity 216 between the packer unit 200 and the outer case 122 which is intersected by the ports 212. An annular piston or sleeve valve member 218 is longitudinally slidably disposed within the cavity 216. The valve member 218 carries upper and lower outer annular sealing members 220 and 222 and an upper inner annular sealing member 224 which provide sliding sealing engagement between the valve member 218 and the outer and inner walls of the annular cavity 216. The valve member 218 is initially releasably secured within the annular cavity 216 by means of one or more shear pins (not shown) threadedly secured to the wall of the packer unit 200 and received in corresponding cavities formed in the outer surface of the valve member 218. This structure is illustrated in FIG. 8 of U.S. Pat. No. 3,948,322. In this initial position, as shown in FIG. 6, the lower end of the valve member 218 is preferably in abutment with the annular shoulder 210 of the packer 200. It is deemed preferable to fill the cavity 216 of the valve member 218 with grease.

A downwardly facing annular shoulder 226 is formed on the interior of the packer unit 200 adjacent the ports 130 in the outer case 122. A cylindrical inner surface 228 extends downwardly from the annular shoulder 226 to a radially inwardly extending shoulder 230 which in turn communicates with a second cylindrical inner surface 232 which communicates with a third cylindrical inner surface 234 via a tapered annular shoulder 236. The annular shoulers 226 and 230 and the cylindrical surface 228 form an annular groove on the interior of the packer unit 200 in which a resilient annular check valve assembly 238 is firmly secured. The check valve assembly 238 comprises a downwardly extending resilient elastomeric lip which sealingly engages the cylindrical outer surface 198 of the tubular outer case 122. The check valve assembly provides for downward fluid flow therepast between the outer case 122 and the packer unit 200 while preventing reverse upward fluid flow therepast.

The cylindrical inner surface 234 extends downwardly to intersect a tapered annular shoulder 240 which mutually engages a corresponding tapered annular shoulder 242 formed on the outer periphery of the lower body member 128. The annular shoulder 240 communicates with a cylindrical inner surface 244 formed on the lower end portion 204 of the packer unit 200, which surface is slidably received around a cylindrical outer surface 246 formed on the outer periphery of the lower port member 204 and communicating with the annular shoulder 242 thereof. An annular sealing member 248 is carried in an annular groove formed in the cylindrical surface 244 and provides a fluid-tight seal between the lower end portion 204 of the packer unit 200 and the cylindrical surface 246 of the lower body member 128. The lower end portion 204 of the packer unit 200 is retained in engagement with the lower body member 128 by means of an internally threaded nut 250 which is threadedly engaged with external threads formed on the lower body member 128.

The upper and lower end portions 202 and 204 of the inflatable packer unit 200 are interconnected by an intermediate portion 252. The inflatable packer unit 200 is preferably formed of a suitable metal such as aluminum, aluminum alloy, steel or stainless steel. The intermediate portion 252 is formed into a relatively thin, tubular, solid or impervious membrane of such suitable metal, the physical properties of which permit the intermediate portion 252 to expand without repture during the inflation of the inflatable packer unit 200.

A tubular resilient packer sealing member 254 is disposed about and suitably bonded to the outer surface of the intermediate portion 252 and extends between the upper and lower portions 202 and 204 of the inflatable packer unit 200. The packer sealing member 254 is preferably formed of an elastomeric material and may, if desired, be formed of a suitable resilient synthetic resinous material or the like for special applications as desired.

It will be seen that a tubular inflation packer assembly 184 thus far defined provides a sealed, annular cavity 256 between the exterior of the outer case 122 and the lower body member 128 and the inner periphery of the inflatable packer unit 200 intermediate the annular check valve assembly 238 and the annular sealing member 248. An internally threaded port 258 extends through the wall of the upper end portion 202 of the packer unit 200 at a point adjacent to and above the annular check valve assembly 238. The port 258 is closed by an externally threaded removable plug 260. A second internally threaded port 262 extends through the wall of the lower end portion 204 of the inflatable packer unit 200 communicating with the sealed annular cavity 256 at the lower end thereof. The port 262 is closed by a removable, externally threaded plug 264.

After assembly of the full opening packer as shown in FIG. 6, the apparatus is preferably laid on its side with the ports 258 and 262 positioned on top of the tool. The plugs 260 and 264 are removed and a suitable lightweight oil is pumped into the port 258 until the cavity 256 is completely filled with oil. The plugs 260 and 264 are then installed in the respective ports 258 and 262 to achieve a fluid-tight seal trapping oil with the cavity 256. It may be desirable to employ Teflon tape as a sealing element between the plugs 260 and 264 and the respective ports 258 and 262.

Referring now to FIGS. 2A, 2B, 2C, 2D and 2E, the selective opening sleeve positioner assembly of the present invention is illustrated therein and is generally designated by the reference character 270. The sleeve positioner assembly 270 comprises a tubular mandrel 272 having an upper end portion 274 and a lower end portion 276, a tubular threaded adapter 278 is threadedly secured to the upper end portion 274 of the tubular mandrel 272 and provides means for threadedly securing the sleeve positioner assembly 170 to the lower end of a conventional string of drill pipe. A fluid-tight seal is achieved between the adapter 278 and the mandrel 272 by means of an O-ring 280 disposed therebetween and carried in an annular groove formed in the adapter 278.

The sleeve positioner assembly 270 includes an opening positioner 282 comprising a plurality of spring arms284 fixedly secured to a spring collar 286 which encircles the mandrel 272 in a circumferential recess 288 formed on the upper end portion 274 thereof. The spring collar 286 is retained in the recess 288 through abutting engagement therewith by the lower end face 290 of the adapter 278.

A tubular threaded lower adapter 292 is threadedly secured to the lower end portion 276 arms 284 the tubular mandrel 272, and a fluid-tight seal is achieved therebetween by an O-ring 294 carried in an annular groove formed in the adapter 292.

Each spring arm 284 of the opening positioner 282 is provided with a radially outwardly extending shoulder 296 in which is embedded one or more carbide buttons 298. Each shoulder 296 includes sloped upper and lower surfaces 300 and 302 which act as wedges or cams to drive the respective spring arm 284 radially inwardly when contacting projections formed on the interiors of the valve sleeve of the cementing and gravel collars and the cementing and gravel packers, as well as the interiors of the upper body members of the collars and packers. The shoulders 296 act as centralizers for the positioner 282 to keep it centered within the tubing string. The buttons 298 reduce friction wear on the positioner 282.

Each spring arm 284 also includes a radially aligned or perpendicular shoulder 304 which is adapted to engage the corresponding annular shoulder 98 in the valve sleeve 78 of each full opening collar or the annular shoulder 152 in the valve sleeve 124 of each full opening packer, thereby allowing the valve sleeves to be pulled up into the open position by lifting up on the drill string on which the sleeve positioner assembly 270 is installed.

The tips 306, each located at the free end of a respective spring arm 284, project inwardly toward the axis of the opening positioner 282 and are located on a smaller radius than the radius of the minimum diameter of the tubing string through which the selective opening sleeve positioner assembly 270 is to be operated. A sloping face 308 formed on the lower end of each spring arm 284 provides a wedging or cam action which pushes the respective spring arm 284 radially inwardly when an inner projection within any of the valve sleeves is encountered by the face 308, thereby allowing the positioner 282 to travel downwardly through the various valve sleeves relatively unimpeded.

The spring arms 284 are thus arranged so that, on downward moement through the valve sleeves, no part of the arms 284 will engage the valve sleeves sufficiently enough to move the valve sleeves downwardly by overcoming the spring tension of the respective collet fingers on the inner surfaces of the respective outer housings or cases. Thus, downward movement of the opening positioner 284 will have no effect on the valve mechanism of the full opening collars and packers described above, and the positioner 282 can pass downwardly entirely through the various valve sleeves without changing the porting orientation between the valve sleeves and their respective outer cases.

The shoulder 296 on each spring arm 284 also serves the function of a releasing cam when the respective spring arm 284 is engaged in one of the valve sleeves 78 or 124 and has moved the particular valve sleeve to the uppermost position within the respective outer case 76 or 122, thereby placing the ports 84 and 86 in registration to open a full opening collar or placing the ports 130 and 132 in registration to open the valve mechanism in a full opening packer. In order that the opening positioner 282 can be pulled upwardly out of a valve sleeve after the respective valve mechanism has been opened, the shoulders 296 are located on the spring arms 284 so that when the valve sleeve is at the top of its travel, the shoulders 296 abut the tapered or beveled annular shoulders 310 or 312 of the respective upper body members 80 or 126 of the full opening collars or full opening packers, thereby driving the shoulders 296 and the spring arms 284 radially inwardly resulting in the disengagement of the shoulders 304 of the arms 284 from the annular shoulders 98 or 152 of the valve sleeves 78 or 124, respectively.

The selective opening sleeve positioner assembly 270 additionally includes a drag block assembly 134 longitudinally slidably disposed about the tubular mandrel 272 intermediate the opening positioner 282 and the lower adapter 292. The drag block assembly 314 comprises a substantially cylindrical drag block body 316 having an upper end portion 318 and a lower end portion 320. A tapered or beveled annular surface 322 extends downwardly from the upper end face 324 of the drag block body 316 to a radial shoulder 326 which in turn communicates with the cylindrical inner surface 328 of the drag block body 316. A plurality of ports 330 communicates between the annular surface 322 adjacent the radial shoulder 326 and the substantially cylindrical outer surface 332 of the drag block body 316.

A plurality of drag blocks 334 are disposed in corresponding circumferentially equally spaced longitudinal slots 336 formed in the drag block body 316. Each drag block 334 is retained within the corresponding slot 336 by means of a pair of brackets 338 and 340 each secured to the drag block body 316 by a respective threaded bolt 342. Each drag block 334 is biased outwardly within its respective longitudinal slot 336 by means of a drag block spring 344 disposed within the slot 336.

Figure 13:
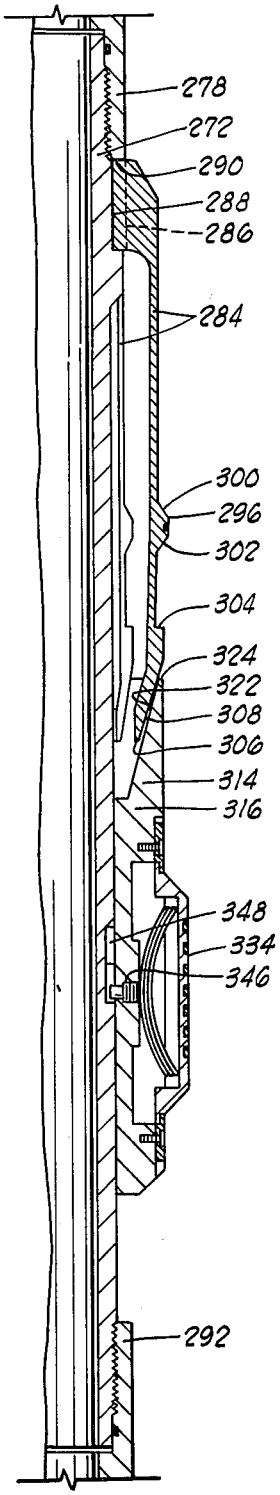
FIG. 13 is a partial vertical cross-sectional view of a portion of the selective opening sleeve positioner assembly illustrating the drag block body in engagement with the opening positioner spring arms maintaining the spring arms in a deactivated, retracted position.
Figure 11:
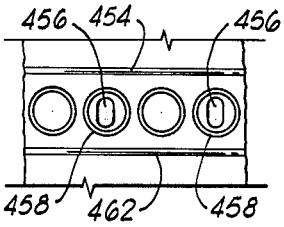
FIG. 11 is a partial planar elevation view of the cylindrical exterior of the bypass valve body illustrating the port and seal configuration thereof.
Figure 12:
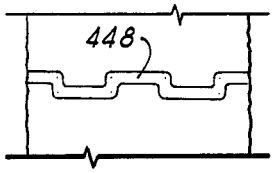
FIG. 12 is a partial planar elevation view of the cylindrical exterior of the valve body of the rotary bypass valve illustrating the continuous J-slot configuration thereof.
Figure 14:
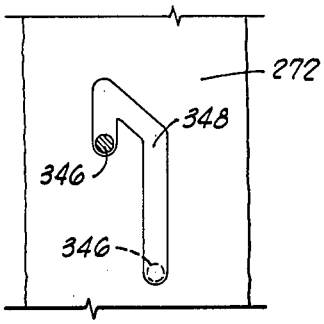
FIG. 14 is a partial planar elevation view illustrating the details of the drag block J-slot construction in the mandrel of the selective opening sleeve positioner assembly.

The drag block assembly 314 further includes a pair of J-slot pins 346 (one shown) mounted in and extending inwardly from the drag blocks 316 and received in a pair of corresponding J-slots 348 (one shown) formed in the exterior of the tubular mandrel 272. FIG. 14 illustrates one of the J-slots 348 formed in the tubular mandrel 272 in planar elevation. It will be noted that the J-slot pin 346 illustrated in dashed lines in FIG. 14 illustrates the position of the J-slot pin 346 in the J-slot 348 in FIG. 2A. In this position, the drag block assembly 314 is in its lowermost position on the tubular mandrel 272 and is spaced a distance below the spring arms 284 of the opening positioner 282. The J-slot pin 346 illustrated in solid lines in FIG. 14 illustrates the position of the J-slot pins in the respective J-slots 348 when the drag block assembly 314 is in its uppermost locked position as illustrated in FIG. 13. The operation of the drag block assembly 314 in relation to the opening positioner 282 will be described in detail hereinafter in the description of the overall operation of the selective opening sleeve positioner assembly 270 in the performance of an open hole, multi-zone, gravel pack completion.

Figure 2A:
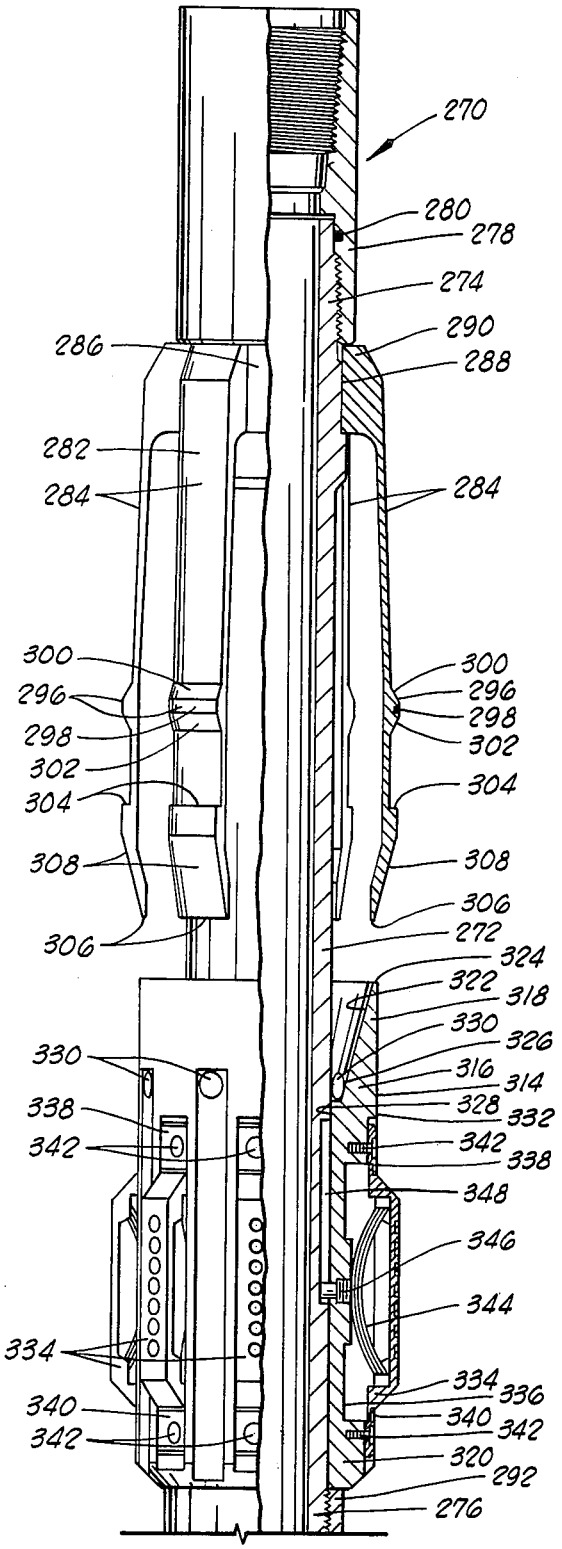
FIGS. 2A, 2B, 2C, 2D and 2E show the selective opening sleeve positioner assembly in elevation with one-half of the assembly in vertical cross-section.
Figure 2B:
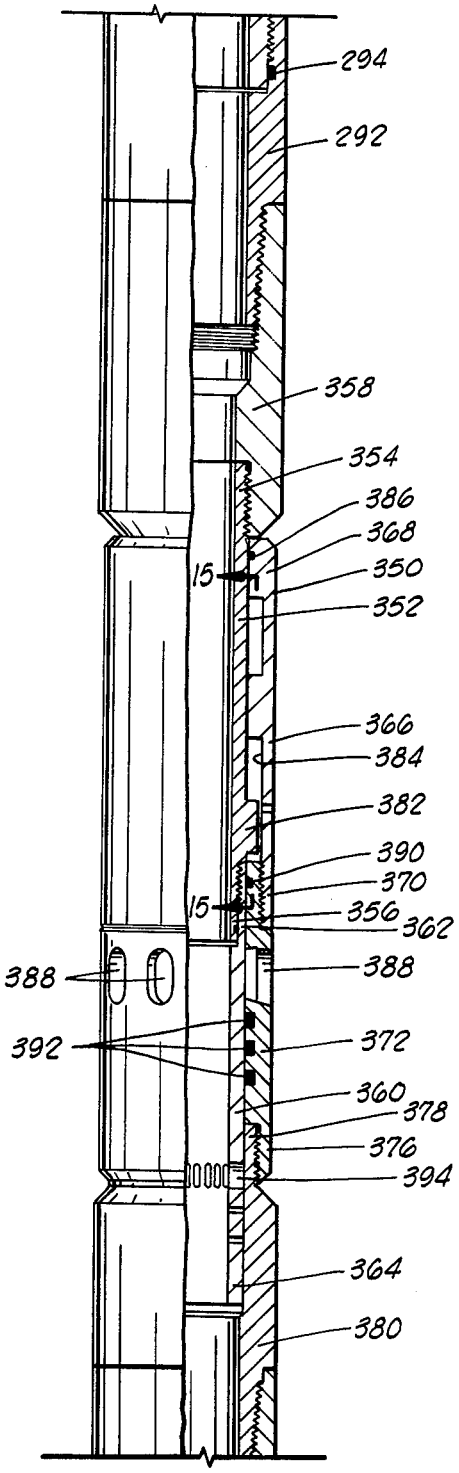

The selective opening sleeve positioner assembly 270 further includes a circulating valve 350 operable through vertical manipulation of the drill string. The valve suitable for this application is designated as the retrievable test treat and squeeze circulating valve manufactured by Halliburton Services, Duncan, Oklahoma. The valve 350 comprises a tubular lug section mandrel 352 having an upper end portion 354 and a lower end portion 356. The upper end portion 354 is threadedly secured to a tubular threaded coupling 358 which is, in turn, threadedly secured to the lower adapter 292 as best shown in FIG. 2B.

A tubular port section mandrel 360 having an upper end portion 362 and a lower end portion 364 is threadedly secured at the upper end portion 362 to the lower end portion 356 of the lug section mandrel 352. The assembled mandrels 352 and 360 are longitudinally slidably received within a housing comprising a tubular J-slot sleeve 366, having an upper end portion 368 and a lower end portion 370, and a tubular body 372 having an upper end portion 374 threadedly secured to the lower end portion 370 of the J-slot sleeve 366. The lower end portion 376 is threadedly secured to the upper end portion 378 of a tubular lower body member 380.

The lug section mandrel 352 includes a pair of radially outwardly extending J-slot lugs 382 (one shown) which are received in respective J-slots 384 (one shown) formed in the inner surface of the J-slots sleeve 366. A sliding fluid-tight seal is achieved between the J-slot sleeve 366 and the lug section mandrel 352 by means of an O-ring 386 providing sealing engagement therebetween and carried in an annular groove formed in the J-slot sleeve 366.

A plurality of ports 388 extend through the wall of the tubular body 372 in circumferentially spaced relation. A sliding fluid-tight seal is achieved between the body 372 and the port section mandrel 360 by means of an O-ring 390 carried in an annular groove in the body 372 above the ports 388. A sliding fluid-tight seal is also maintained between the body 372 and the port section mandrel by means of three longitudinally spaced O-rings 392 carried in respective longitudinally spaced annular grooves formed in the inner wall of the tubular body 372 below the ports 388. A plurality of ports 394 are formed in the lower end portion 364 of the port section mandrel 360 in circumferentially spaced relation.

Figure 15:
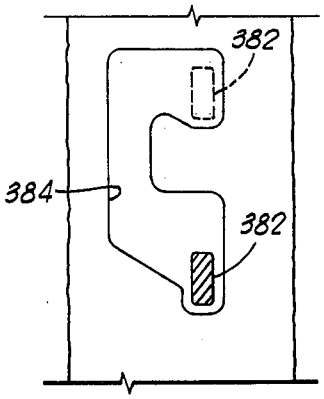
FIG. 15 is a cross-sectional view taken along line 15—15 of FIG. 2B illustrating the details of the J-slot construction of the circulating valve in the selective opening sleeve positioner assembly.

FIG. 15 illustrates the J-slot 384 formed in the J-slot sleeve 366. The J-slot lug 382 illustrated in solid lines in FIG. 15 corresponds to the position of the J-slot lug 382 in the J-slot 384 as shown in FIG. 2B when the circulating valve is closed with the ports 394 and 388 maintained out of registration. When the J-slot lug 382 is in the position illustrated by the dashed lines in FIG. 15, the circulating valve 350 is in the open, circulating position with the ports 394 and 388 in registration. The main function of the circulating valve 350 is to provide means for avoiding the pulling of a wet string of drill pipe. To open the valve 350, the drill pipe is picked up while imparting right hand rotation thereto.

The selective opening sleeve positioner assembly 270 further includes a bypass valve 396 positioned directly below the circulating valve 350. The bypass valve 396 includes a tubular valve housing 398 having an upper end portion and a lower end portion 402 with the upper end portion 400 threadedly secured to the lower end portion 404 of a tubular swivel coupling 406. The upper end portion 408 of the swivel coupling 406 is threadedly secured to the lower end portion 410 of a tubular threaded adapter 412. The upper end portion 414 of the adapter 412 is threadedly secured to the lower end portion 416 of the lower body member 380.

A pair of diametrically opposed ports 418 (one shown) extend through the wall of the lower end portion 402 of the valve housing 398. A pair of diametrically opposed inwardly extending J-slot pins 420 (one shown) are mounted in the lower end portion 402 of the valve housing 398 intermediate the ports 418 and the lower end portion 404 of the swivel coupling 406.

A fluid-tight seal is maintained between the adapter 412 and the swivel coupling 406 through mutual engagement with an O-ring 422 carried in an annular groove at the lower end portion 410 of the adapter 412. A fluid-tight seal is maintained between the swivel coupling 406 and the valve housing 398 through mutual engagement with an O-ring 424 carried in an annular groove in the valve housing 398.

A mandrel assembly 426 is disposed within the valve housing 398, swivel coupline 406 and adapter 412, and is adapted for both reciprocating longitudinal movement and rotational movement therein. The mandrel assembly 426 includes a tubular swivel anchor 428 having an upper end portion 430 and a lower end portion 432. An annular rib 434 extends radially outwardly from the upper end portion 430 of the swivel anchor. Upper and lower annular bushings 436 and 438 are disposed respectively above and below the annular rib 434 and provide rotational support for the mandrel assembly 426 between the valve housing 398 and the adapter 412. It will be seen that a predetermined longitudinal space is maintained between the lower end face of the adapter 412 and the upper end face of the valve housing 398 to thereby define a predetermined amount of reciprocal longitudinal motion between the mandrel assembly 426 and the remainder of the bypass valve 396 comprising the valve housing 398, swivel couplind 406 and adapter 412. A sliding fluid-tight seal is maintained between the upper end portion 430 of the swivel anchor 428 and the lower end portion 410 of the adpater 411 through mutual engagement with an O-ring 440 carried in an annular groove in the swivel anchor. A sliding fluid-tight seal is maintained between the swivel anchor 428 and the upper end portion 400 of the valve housing 398 through mutual engagement with an O-ring 442 carried in an annular groove in the valve housing 398.

A tubular valve body 444 is threadedly secured to the lower end portion 432 of the swivel anchor 428 with a fluid-tight seal provided therebetween by an O-ring 446 carried in an annular groove in the valve body 444. A continuous J-slot 448 is formed in the cylindrical outer surface of the upper end portion 450 of the valve body in which the J-slot pins 420 are received. An O-ring 452 carried in an annular groove in the upper end portion 450 of the valve body provides a sliding fluid-tight seal between the valve body and the valve housing above the J-slot 448. An O-ring 454 also carried by the valve body 444 provides a sliding fluid-tight seal between the valve body and the valve housing 398 below the J-slot 448. A pair of diametrically opposed ports 456 (one shown) extend through the walls of the valve body 444 longitudinally adjacent the ports 418 of the valve housing 398. Each port 456 is encircled by an O-ring 458 carried in a circular groove 460 formed in the cylindrical outer surface of the valve body 444. The O-rings 458 provide a continuous fluid-tight seal between the valve body 444 and the valve housing 398. An O-ring 462 is carried in an annular groove in the outer surface of the valve body 444 below the lowermost portion of the grooves 460 and provides a sliding fuid-tight seal between the valve body 444 and the lower end portion 402 of the valve housing 398 below the ports 418.

The lower end portion 464 of the valve body 444 is threadedly secured to the upper end portion 466 of a tubular port coupling 468, with a fluid-tight seal being achieved therebetween through mutual engagement with an O-ring 470 carried in an annular groove in the upper end portion 466 of the port coupling 468. A downwardly facing annular sealing cup assembly 472 is disposed about the lower end portion 464 of the valve body 444 directly above the upper end face 474 of the port coupling 468. The cup assembly 472 is secured in this position by means of an internally threaded annular show 476 which is threadedly secured to external threads on the valve body 444 directly above the sealing cup assembly 472. An O-ring 478 carried in an annular groove in the sealing cup assembly 472 provides sealing engagement between the cup assembly and the outer surface of the valve body 444. The lower portion 480 of the cup assembly 472 is preferably formed of a resilient elastormeric material which will provide a sliding seal with the inner surface of the various components of the liner assembly through which the selective opening sleeve positioner assembly 270 may be passed.

Figure 2C:
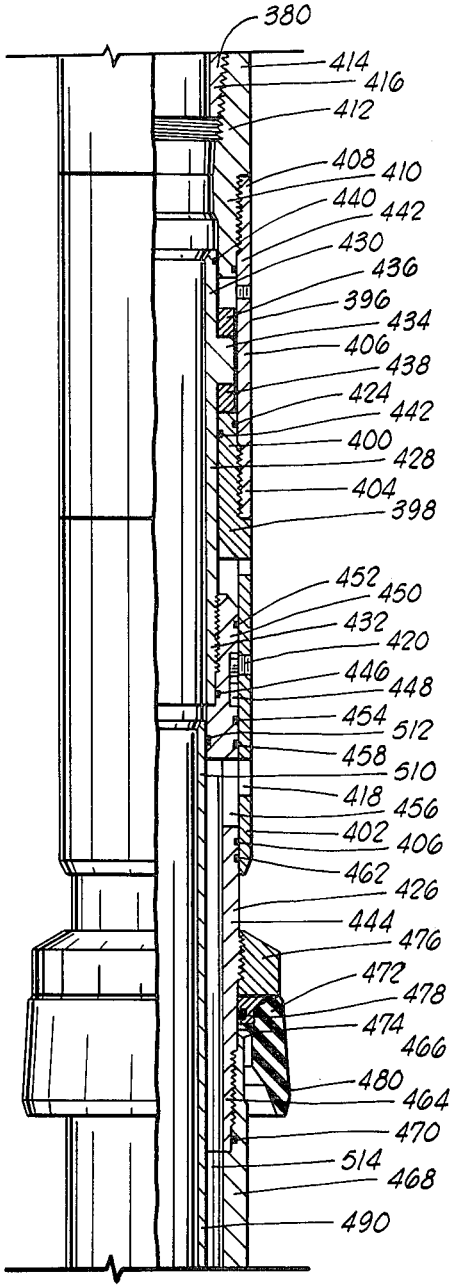
Figure 2D:
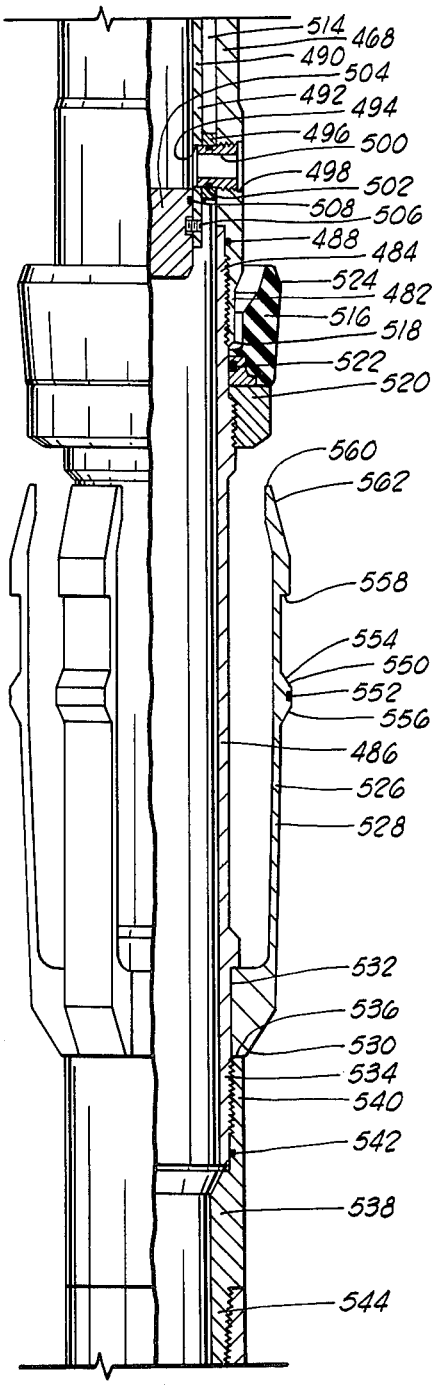
Figure 2E:
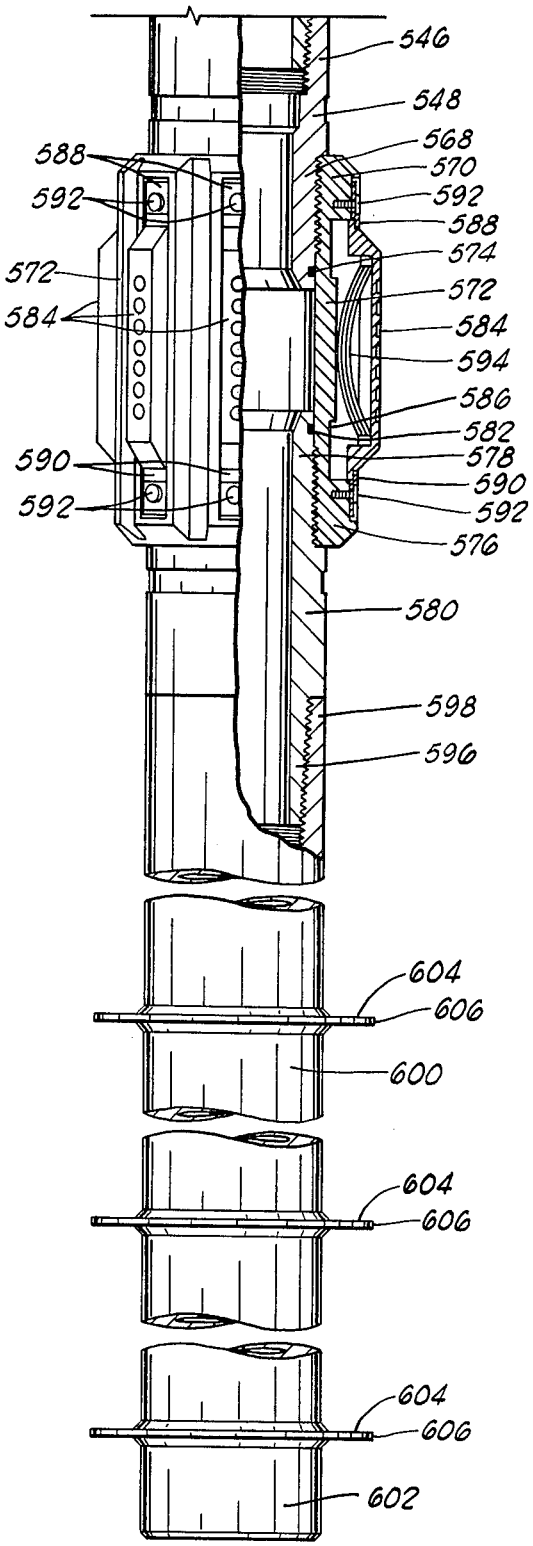

Referring now to FIG. 2D, it will be seen that the lower end portion 482 of the port coupling 468 is threadedly secured to the upper end portion 484 of a tubular positioner mandrel 486, and a fluid-tight seal is achieved therebetween through mutual engagement with an O-ring 488 carried in an annular groove in the lower end portion 482 of the port coupling 468.

A tubular inner mandrel 490 is disposed concentrically within the port coupling 468 and extends upwardly therefrom into the valve body 444 as shown in FIG. 2C. The lower end portion 492 of the inner mandrel 490 is provided with a pair of diametrically opposed ports 494 each having a radially outwardly extending short length of conduit 496 coaxially aligned therewith and fixedly secured to the outer surface of the inner mandrel 490. Each length of conduit 496 is sized to loosely contact the cylindrical inner surface of the port coupling 468 thereby centralizing the inner mandrel within the port coupling. The ports 492 are aligned in registration with a corresponding pair of ports 498 extending through the wall of the port coupling 468. Each port 498 is internally threaded and receives an externally threaded tubular nozzle 500 therein, the inner end portion of which is received within a corresponding conduit 496. A fluid-tight seal is achieved between each nozzle 500 and conduit 496 through mutual engagement with an O-ring 502 carried in an annular groove in the inner end portion of the nozzle.

The lower end portion 492 of the inner mandrel 490 is closed by a plug 504 which is secured therein by a plurality of shear pins 506 mutually engaging the plug 504 and the inner mandrel 490. A fluid-tight seal is achieved between the plug 504 and the inner mandrel 490 through mutual engagement with an O-ring 508 carried in an annular groove formed in the plug 504 above the shear pins 506.

It will be seen that the inner mandrel 490 is secured within the port coupling 468 by means of the nozzles 500. The upper end portion 510 of the inner mandrel 490 is sealingly engaged with the interior of the valve body 444 through mutual engagement with an O-ring 512 carried in an annular groove formed in the valve body 444.

It will also be seen that the inner mandrel 490, the port coupling 468 and valve body 444 defined an annular passage 514 which communicates with the ports 456 of the valve body 444 and extends downwardly from the O-ring 512 to the interior of the selective opening sleeve positioner assembly 270 below the plug 504.

An upwardly facing sealing cup assembly 516, identical in construction to the sealing cup assembly 472, is disposed about the upper end portion 484 of the positioner mandrel 486 directly below the lower end face 518 of the port coupling 468. The sealing cup assembly 516 is retained in this position by an internally threaded shoe 520, identical in construction to the shoe 476, which is threadedly secured to external threads formed on the positioner mandrel 486 directly below the sealing cup assembly 516. A fluid-tight seal is achieved between the cup assembly 516 and the positioner mandrel 486 through mutual engagement with an O-ring 522 carried in an annular groove in the sealing cup assembly 516. The upper portion 524 of the sealing cup assembly 516 is formed of a resilient elastomeric material and provides sealing engagement between the selective opening sleeve positioner assembly 270 below the nozzles 500 nd the inner surfaces of the liner assembly through which the assembly 270 may be moved.

Figure 5:
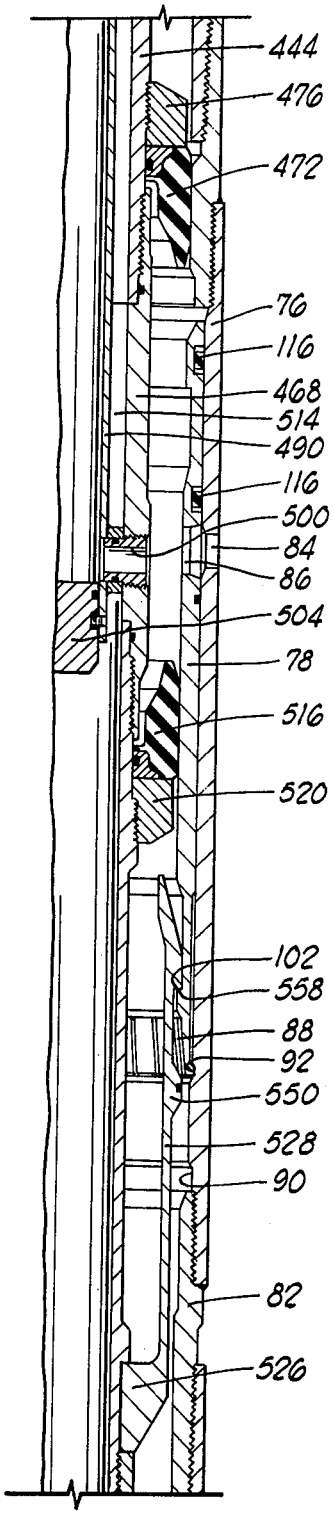
FIG. 5 is a partial vertical cross-sectional view of the collar of FIG. 3 engaged with the selective opening sleeve positioner assembly showing the valve mechanism in the open position ready to pump gravel.

The sealing cup assemblies 476 and 516 cooperate to form an isolation packer structure which serves to isolate the annulus between the selective opening sleeve positioner assembly 270 and the liner assembly immediately above and below the nozzles 500. This structure isolates the lower ends of the valve sleeves 78 and 124 from being contacted by cement, gravel or other fluids being pumped through the nozzles, as is best shown in FIG. 5 and in FIG. 8.

The sleeve positioner assembly 470 further includes a closing positioner 526 comprising a plurality of spring arms 528 fixedly secured to a spring collar 530 which encircles the positioner mandrel 486 in a circumferential recess 532 formed on the lower end portion 534 thereof. The spring collar 530 is retained in the recess 532 through abutting engagement therewith by the upper end face of the tubular lower body member 538 the upper end portion 540 of which is threadedly engaged with the lower end portion 534 of the positioner mandrel 486. A fluid-tight seal is achieved between the positioner mandrel 486 and the lower body member 538 through mutual engagement with an O-ring 542 carried in an annular groove in the lower body member 538.

The lower end portion 544 of the lower body member 538 is threadedly secured to the upper end portion 546 of a tubular adapter 548.

Each spring arm 528 of the closing positioner 526 is provided with a radially outwardly shoulder 550 in which is embedded one or more carbide buttons 552. Each shoulder 550 includes sloped upper and lower surfaces 554 and 556 which act as wedges or cams to drive the respective spring arm 528 radially inwardly when contacting projections formed on the interiors of the valve sleeves of the cementing and gravel collars and of the cementing and gravel packers, as well as the interiors of the lower body members of the collars and packers. The shoulders 550 act as centralizers for the positioner 526 to keep it centered within the tubing string. The buttons 552 reduce friction wear on the positioner 526.

Each spring arm 528 also includes a radially aligned or perpendicular shoulder 558 which is adapted to engage the corresponding annular shoulder 102 of the valve sleeve 78 of the full opening collar or the annular shoulder 156 of the valve sleeve 124 of the full opening packer, thereby allowing the valve sleeves to be moved down into the open position by setting weight on the drill string on which the sleeve positioner assembly 270 is installed.

The tips 560, each located at the free end of a respective spring arm 528 project inwardly toward the axis of the closing positioner 526 and are located on a radius smaller than the radius of the minimum diameter of the tubing string through which the selective opening sleeve positioner assembly 270 is to be operated. A sloping force 562 formed on the upper end of each spring arm 528 provides a wedging or cam action which pushes the respective spring arm 528 radially inwardly when an inner projection within any of the valve sleeves is encountered by the face 562, thereby allowing the positioner 526 to travel upwardly through the various valve sleeves relatively unimpeded.

The spring arms 528 are thus arranged so that, on upward movement through the valve sleeves, no part of the arms 528 will engage the valve sleeves sufficiently enough to move the valve sleeves upwardly by overcoming the spring tension of the respective collet fingers on the inner surfaces of the respective outer housings. Thus, upward movement of the closing positioner 526 will have no effect on the valve mechanisms of the full opening collars and packers described above, and the positioner 526 can pass upwardly entirely through the various valve sleeves without changing the porting orientation between the valve sleeves and the respective outer housings.

The shoulder 550 on each spring arm 528 also serves the function of a releasing cam when the respective spring arm 528 is engaged in one of the valve sleeves 78 and 124 and has moved the particular valve sleeve to the lowermost position within the respective outer case 76 or 122, thereby placing the ports 84 and 86 out of registration to close the valve mechanism in a full opening collar or placing the ports 130 and 132 out of registration to close the valve mechnism in a full opening packer. In order that the closing positioner 526 can be moved downwardly out of a valve sleeve after the respective valve mechanism has been closed, the shoulders 550 are located on the spring arms 528 so that when the valve sleeve is at the bottom of its travel, the shoulders 550 abut the tapered or beveled annular shoulders 564 or 566 of the respective lower body members 82 or 128 of the full opening collars or full opening packers, thereby driving the shoulders 550 and the spring arms 528 radially inwardly resulting in the disengagement of the shoulders 558 of the arms 528 from the annular shoulders 102 or 156 of the valve sleeves 78 or 124, respectively.

The lower end portion 568 of the adapter 548 is threadedly secured to the upper end portion 570 of a tubular drag block body 572. A fluid-tight seal is achieved between the adapter 548 and the drag block body 572 through mutual engagement with an O-ring 574 carried in an annular groove in the adapter 548. The lower end portion 576 of the drag block body 572 is threadedly secured to the upper end portion 578 of a lower tubular adapter 580. A fluid-tight seal is achieved between the drag block body 572 and the lower adapter 580 through mutual engagement with an O-ring 582 carried in an annular groove in the lower adapter 580.

A plurality of drag blocks 584 are disposed in corresponding circumferentially equally spaced longitudinal slots 586 formed in the drag block body 572. Each drag block 584 is retained within the corresponding slot 586 by means of a pair of brackets 588 and 590 each secured to the drag block body 572 by a respective threaded bolt 592. Each drag block 584 is biased outwardly within its respective longitudinal slot 586 by means of a drag block spring 594 disposed within the slot 586.

The lower end portion 596 of the lower adapter 580 is threadedly secured to the upper end portion 598 of the tail pipe 600. The tail pipe 600 extends downwardly from the adapter 580 to an open lower end portion 602. The tal pipe 600 preferably includes one or more fluid flow control baffles 604 of annular shape secured to the exterior of the tail pipe 600 in longitudinally spaced relation therealong. Each of these baffles 604 is preferably formed of a suitable resilient elastomeric material. The circular peripheral edge 606 of each baffle 604 has a diameter slightly greater than the inside diameter of the liner assembly through which the selective opening positioner assembly 270 is to be manipulated during a gravel pack completion. The baffles 604 are employed on the tail pipe 600 to provide uniform gravel packing and to prevent the premature bridging of gravel which might otherwise be encountered when a selective opening sleeve positioner assembly 270 is employed in the gravel packing of a relatively long producing interval in a well bore. The use of such fluid flow control baffles in gravel pack well completions is disclosed in U.S. Pat. No. 3,153,451 issued to Chancellor et al. and U.S. Pat. No. 3,637,010 issued to Maly et al., which patents are incorporated herein by reference.

OPERATION

The selective opening sleeve positioner assembly 270 is advantageously employed in open hole, multi-zone gravel pack completions such as the one schematically illustrated in FIGS. 1A and 1B. As mentioned above, the sleeve positioner assembly 270 is threadedly secured to the lower end of a drill pipe string which extends downwardly from a rig floor and provides a conduit for transmitting gravel, cement or other liquids or solid/liquid slurries into the well bore.

The full opening collars 22, 30, 36 42 and 48 are used to place cement or gravel between the liner assembly 10 and the well bore 12 at these predetermined locations. The full opening packers 28, 34, 40 and 46 are used to isolate various zones to be either cemented or gravel packed. When the liner assembly 10 is landed and hung with the liner hanger casing packer 18 set, as shown in FIGS. 1A and 1B, the drill string with the sleeve positioner 270 installed thereon is lowered through the casing 14 and into the liner assembly 10 to initially locate and test each of the full opening collars. It should be noted that the spring arms 284 and the open positioner 282 are automatically retracted through the action of the drag block assembly 314 when the sleeve positioner 217 is lowered through the liner assembly 10. This condition is best illustrated in FIGS. 13 and 14. The J-slot pins 346 move upwardly within the respective J-slots 348 to the uppermost blocked position as shown in FIG. 14 due to the resistance imparted to the drag block assembly 314 by the drag blocks 334 as they engage the interior of the liner assembly 10. The drag block assembly 314 will remain in the position illustrated in FIG. 13 until the operatior desires to release the spring fingers 284 which can be achieved by setting the drill string down with right hand rotation and then picking up, thus moving the J-slot pins 346 to the position indicated by the dashed lines with the respective J-slots 348 as illustrated in FIG. 14. This condition of the spring arms 284 is best illustrated in FIG. 2A.

The capablity of the selective opening sleeve positioner assembly 270 to permit the operator to retain the opening positioner spring arms 284 in a retracted position until such time as he desires to release them, permits the assembly 270 to be freely passed upwardly through the full opening collars and packers in the liner assembly 10 without disturbing the valve sleeves thereof when they are in the closed position. This provides great flexiblity to an operator who many times may need to selectively actuate one of the packers or collars in a liner assembly which entails moving the sleeve positioner assembly upwardly through closed valve sleeves which must not be opened.

Figure 3:
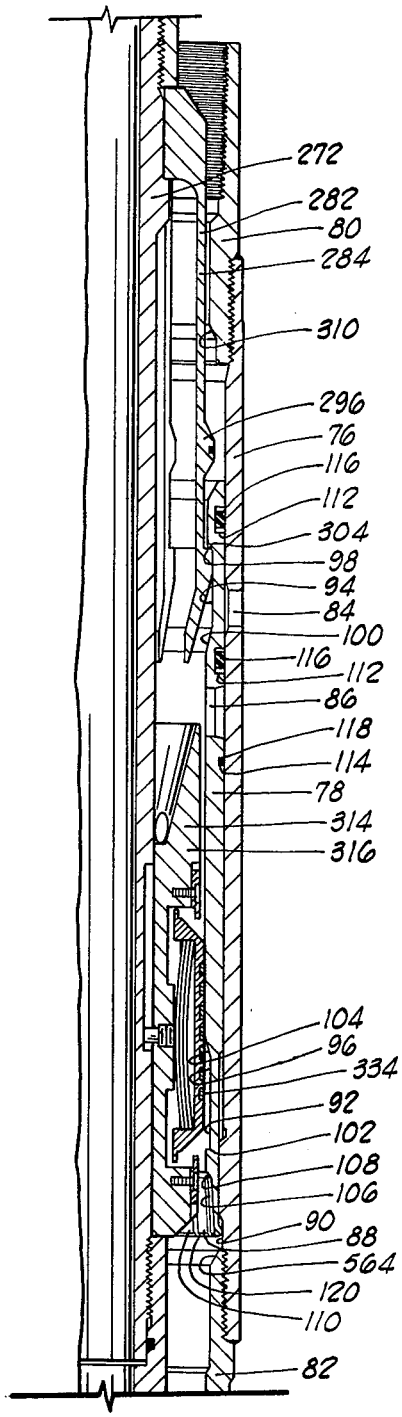
FIG. 3 is a partial vertical cross-sectional view of a full opening gravel or cementing collar engaged with the selective opening sleeve positioner assembly showing the valve mechanism in the closed position.

When the liner assembly 10 is landed and hung with the liner hanger casing packer 18 set as shown in FIGS. 1A and 1B, each of the full opening collars and packers is located with the sleeve positioner assembly 270 on the drill string and the valve mechanism is tested to assure operability and to precisely locate and log the position of each full opening collar and packer. FIGS. 3, 4 and 5 illustrate the actuation of the full opening collars by means of the sleeve positioner assembly 270 solely through vertical manipulation of the sleeve positioner assembly 270. Similarly, FIGS. 6, 7, 8 and 9 illustrate the operation of the full opening packers solely through vertical manipulation of the sleeve positioner assembly 270.

The operator initially tags the bottom of the liner assembly 10 with the selective opening sleeve positioner assembly 270 and logs the depth. The drill string is then raised a distance upwardly and the opening positioner spring arms 284 are released by setting down on the drill string with right hand rotation and then picking the drill string up. This action moves the drag block assembly 314 from engagement with the spring arms 284, as illustrated in FIG. 13, to the position illustrated in FIG. 3 thus freeing the spring arms 284 for engagement with the valve sleeve of the full opening collar 48. The sleeve positioner assembly 270 is raised until the shoulders 304 of the spring arms 284 engage the shoulder 98 of the valve sleeve 78 as illustrated in FIG. 3. This engagement is indicated at the rig floor due to the resistance to upward movement of the valve sleeve 78 caused by engagement of the collet fingers 88 in the annular groove 90 in the outer housing 76. Upon the application of an upward pull to the drill string of approximately 20,000 pounds of force, the collet fingers 88 release and the valve sleeve 78 is moved upwardly within the housing 76 to the position illustrated in FIG. 4, thereby placing the ports 84 and 86 in registration and opening the valve. Any further movement of the drill string upwardly within the liner assembly 10 automatically releases the spring arms 284 from the valve sleeve 78 through the camming action between the upper surfaces 300 of the spring arms 284 and the tapered annular shoulder 310 of the tubular upper body.

The drill string is picked up approximately ten feet above the open valve position and is then lowered until the shoulders 558 of the closing positioner spring arms 528 engage the radial shoulder 102 of the valve sleeve 78 as illustrated in FIG. 5.

This downward movement of the drill string and sleeve positioner assembly 270 will also cause the drag block assembly 314 to automatically recock and retract the opening positioner spring arms 284 thus achieving the condition illustrated in FIG. 13. This engagement will be signaled to the rig floor due to the resistance of the collet fingers 88 which are then engaged in the annular groove 92 in the outer housing 76. It will be noted then that the sealing cup assemblies 472 and 516 of the sleeve positioner assembly 270 isolate the annulus between the exterior of the sleeve positioner assembly 270 and the interior of the valve sleeve 78, and that the nozzles 500 are aligned in registration with the ports 84 and 86. The downward movement of the drill string should be stopped when the weight indicator on the rig floor starts to slack off due to the engagement of the closing positioner spring arms 528 with the valve sleeve 78. It will be seen that when the selective opening sleeve positioner assembly 270 and the valve sleeve 78 of the full opening collar are in the position illustrated in FIG. 5, cement or gravel can be pumped down the drill pipe and through the nozzles 500 and ports 84 and 86 into the annulus between the liner assembly 10 and the well bore 12. This, however, is not done during the initial logging and testing of the full opening collars.

Valve sleeve 78 can then be closed by setting down on the drill string to apply approximately 20,000 pounds of force to the valve sleeve 78 thereby disengaging the collect fingers 88 from the annular groove 92 in the housing 76 and moving the valve sleeve 78 back to the closed position illustrated in FIG. 4.

The drill string and sleeve positioner assembly 270 can then be retrieved upwardly through the closed full opening collar without disturbing the position of the valve sleeve 78 to a position above the full opening collar.

This procedure is repeated for each of the full opening collars to log their positions and to test their operability. The same procedure can be employed in logging the position of and testing the operability of the sleeve valve mechanisms of the full opening packers.

The full opening packers are then ready to set. The packers are preferably set from bottom to top in the liner assembly 10. The selective opening sleeve positioner assembly 270 is lowered to a position below the inner valve sleeve 124 of the full opening packer 46 and the opening positioner spring arms 284 are released by setting down drill string weight on the sleeve positioner assembly 270 with right hand rotation and then lifting up on the drill string as described above. The selective opening sleeve positioner assembly 270 is then raised by the drill string until the shoulders 304 of the spring arms 284 engage the radial shoulder 152 of the valve sleeve 124. This engagement will be registered at the rig floor by an increase displayed on the weight indicator. FIG. 6 illustrates the relation of a sleeve positioner assembly 270 and the full opening packer 46 at this point. An upward pull on the drill string of approximately 20,000 pounds force disengages the collet fingers 172 of the valve sleeve 124 from the annular shoulder 182 in the outer housing 122 thus permitting the valve sleeve 124 to move upwardly therein to the position illustrated in FIG. 7 with the ports 130 and 132 in registration. The drill pipe is then picked up approximately an additional ten feet and then lowered until the shoulders 558 of the closing positioner spring arms 528 engage the radial shoulder 156 of the valve sleeve 124 as shown in FIG. 8. Downward movement of the drill string should be stopped at this point when the weight indicator starts to slack off. At this point, a suitable liquid can be pumped down the drill string through the selective opening sleeve postioner assembly 270, through the nozzles 500 and ports 130 and 132 and downwardly past the annular check valve assembly 238 into the cavity 256 to thereby inflate the packer sealing member 254 and force it into engagement with the wall of the well bore 12 as shown in FIG. 9. Pressure is applied slowly in this manner to the cavity 256 to inflate the packer. At this time, the pressure applied to inflate the packer is maintained below a 1500 psi differential with the hydrostatic pressure in the annulus between the liner assembly 10 and the well bore 12 above the packer. This pressure differential is held by the check valve assembly 238.

The valve sleeve 124 is then closed by setting approximately 20,000 pounds of force on the valve sleeve 124 via the closing positioner spring arms 528 of the sleeve positioner assembly 270 thereby overcoming the retaining force of the collet fingers 172 in their engagement with the outer housing 122. Additional downward movement of the sleeve positioner assembly 270 after the valve sleeve 124 reaches the closed position, as illustrated in FIG. 6, causes the spring arms 528 to disengage from the valve sleeve 124 through the camming action between the shoulder 550 of the spring arms 528 and the annular shoulder 566 of the lower body member 128 as the sleeve positioner assembly 270 moves downwardly.

The selective opening sleeve positioner assembly 270 is then moved downwardly through the full opening collar 48 positioned below the full opening packer 46 and the inner valve sleeve 78 thereof is moved to the open position in the manner described above for testing the full opening collars. The sleeve positioner assembly 270 is then raised approximately ten feet and then lowered until the closing positioner spring arms engage the valve sleeve as illustrated in FIG. 5. Suitable liquid can then be pumped down the drill string through the sleeve positioner assembly 270, through the nozzles thereof and the aligned ports 84 and 86 of the full opening collar into the annulus between the liner assembly 10 and the well bores 12. If no circulation is obtained, confirmation is obtained that the full opening packer above the open full opening collar is properly set. Pressure to the open full opening collar is then reduced and the sleeve positioners assembly 270 is moved downwardly to place the valve sleeve 78 in the closed position. The drill string and selective opening sleeve positioner assembly 270 is then moved upwardly through the liner assembly to the full opening packer next above and the inflation and testing procedure described above is repeated. This procedure is continued until all of the full opening packers have been inflated and confirmed as set.

When all the full opening packers have been set and verified, the first, second and third producing intervals 54, 56 and 58 are gravel packed in that order from top to bottom. To gravel pack the producing interval 54, the selective opening sleeve positioner assembly 270 is manipulated in the manner described above to place the valve sleeve 78 in the open position as illustrated in FIG. 4 and then the sleeve positioner assembly 270 is lowered to the position illustrated in FIG. 5. A liquid gravel slurry is then pumped down the drill string through the sleeve positioner assembly 270 and into the underreamed portion 60 in the producing interval 54 via the nozzles 500 and aligned ports 84 and 86. The gravel in the slurry is deposited in the underreamed portion and the liquid returns are received through the slotted tubing 26 where the returns then pass from the interior of the liner assembly 10 upwardly through the opening in the lower end portion 602 of the tail pipe through the annular passage 514 and into the annulus between the sleeve positioner assembly 270 and the liner assembly 10 via the aligned ports 456 and 418 of the open bypass valve 396, and thence to the ground surface. As noted earlier, the fluid flow control baffles 604 on the tail pipe 600 prevent bridging of the gravel in the annulus above the packer 28 and within the underreamed portion 60 of the producing interval 54. When this gravel packing operation is complete, the sleeve positioner assembly 270 is moved downwardly to close the valve sleeve 78.

In the event it is desired to apply a pressure test to the gravel pack in the end of the packing operation, prior to the closing of the valve sleeve 78, the bypass valve 396 is closed by applying right hand rotation to the drill string with a slight amount of weight applied thereto. This will prevent the collapsing of the slotted tubing 26 when fluid pressure is applied down through the drill string to the gravel packed producing interval. The drag blocks 584 restrain the lower portion of the sleeve positioner assembly 270 as the upper portion of the sleeve positioner assembly is rotated at the swivel mechanism at 406. After a satisfactory pressure test, the valve sleeve 78 can then be closed by setting down on the drill string with approximately 20,000 pounds of force. After approximately three feet of downward movement of the drill string, the drill string is picked up and rotated to the right to open the bypass valve 396 in the sleeve positioner assembly 270. Excess gravel can then be reversed out by pumping liquid down the annulus between the drill pipe and the liner assembly 10.

This gravel packing procedure is repeated for the producing intervals 56 and 58, in that order by pumping the liquid in the liquid/gravel slurry through the open full opening collars 36 and 48, respectively.

After the gravel packing operations have been successfully completed in each of the producing intervals, the liner assembly 10 is then ready to be cemented in the well bore 12. The cement is applied in the annulus between the liner assembly and the well bore intermediate the packers 46 and 40 and intermediate the packers 34 and 28, in that order. The selective opening sleeve positioner assembly 270 is also employed in the cementing operation. The sleeve positioner assembly 270 manipulated as described above to open the valve sleeve 78 of the full opening cementing collar 42. The drill string and sleeve positioner assembly 270 is then lowered downwardly through the liner assembly through the full opening packer 46 and is then manipulated as described above to open the valve sleeve 124 therein, thus achieveing the position illustrated in FIG. 8 in relation to the inflated packer 46. A predetermined quantity of cement is then pumped down through the drill string and sleeve positioner assembly 270, through the nozzles 500 and the aligned ports 130 and 132. The pressure is slowly raised on the cement until the differential pressure between the cement and the fluid in the annulus between the liner assembly and the well bore above the packer 46 exceeds approximately 1500 psi. It will be noted that when the sleeve positioner assembly 270 is employed in the cementing operation, the bypass valve 396 is placed in the closed position, as described above, by applying right hand rotation to the drill string simultaneously with the application of a small amount of drill string weight to the sleeve positioner assembly 270. When the differential pressure between the cement and the annulus pressure adjacent the packer 46 exceeds approximately 1500 psi, the shear pins retaining the annulus piston 218 will rupture and the pressure differential will force the annular piston 218 upwardly, as illustrated in FIG. 9, thus providing a path for the cement to pass from the port 130 through the uncovered port 212 into the annulus above the inflated packer 46. A predetermined amount of cement is pumped downwardly through the drill string and the sleeve positioner assembly 270 through the aligned ports 132 and 130 and uncovered port 212 of the packer 46 and upwardly within the annulus above the inflated packer 46 until the annulus space between the inflated packer 46 and the port 84 of the full opening collar 42 is filled with cement.

At this point it should be noted that the hydrostatic pressure of the cement in the annulus above the inflated packer 46 acts downwardly through the annular check valve assembly 238, to maintain such hydrostatic pressure on the fluid within the cavity 256 of the packer, thus assuring sealing engagement between the packer sealing member 254 and the wall of the well bore 12, thereby preventing collapse of the packer due to the force applied thereto by the column of cement supported thereabove.

At this point, pumping of the cement is discontinued, and approximately 20,000 pounds of force is set down on the sleeve positioner assembly 270 to move the valve sleeve 124 downwardly to its closed position thereby trapping the column of cement in the annulus above the inflated packer 46. The sleeve positioner assembly 270 is then raised within the liner assembly 10 to a position approximately ten feet above the open cement collar 42 at which time the sleeve positioner assembly 270 is lowered into engagement with the valve sleeves 78, as illustrated in FIG. 5, whereupon approximately 20,000 pounds of force is applied thereto by slacking off on the drill string to move the valve sleeve 78 downwardly to its closed position.

This series of actions described with regard to the full opening cementing collar 42 and the full opening packer 46 is then repeated with the full opening cementing collar 30 and the full opening packer 34 to place the column of cement 72 in the annulus above the inflated packer 34.

At the completion of all cementing operations, as well as at the completion of the gravel packing operations, the bypass valve 396 can be opened by picking up the drill string and applying right hand rotation thereto. Excess cement or gravel can then be reversed out of the liner assembly 10, sleeve positioner assembly 270 and drill string by pumping a suitable liquid down the annulus between the drill pipe and the liner assembly 10, through the open bypass valve 396, and downwardly through the annular passage 514 out through the open lower end portion of the tail pipe 600 and back up the annulus between the tail pipe and the liner assembly 10, past the sealing cup assembly 516 and through the nozzles 500 into the interior of the sleeve positioner 270 and up through the drill string for return to the ground surface.

When it is desired to retrieve the drill string and the sleeve positioner assembly 270 from the liner assembly 10, the circulating valve 350 is opened by picking up on the drill string and applying right hand rotation thereto. The retrieval of the drill string and the sleeve positioner assembly 270 can then be achieved without pulling a wet string of drill pipe from the liner assembly 10 since well fluids within the drill string will then be permitted to pass therefrom through the open circulating valve 350 into the annulus between the sleeve positioner assembly 270 and the liner assembly 10, and through the open bypass valve 396 from the annulas into the annular passage 514 and downwardly through the open lower end portion 602 of the tail pipe 600.

In the event difficulty is encountered in operating the valve 350, or if the sleeve positioner assembly 270 is utilized in a modified form without the circulating valve 350 as an integral part thereof, the application of aproximately 2,000 psi fluid pressure down the drill string will shear the shear pins 506 retaining the plug 504 in the lower end portion 492 of the inner mandrel 490, thus allowing fluid to drain through the sleeve positioner assembly 270 and out the opening in the lower end portion 602 of the tail pipe 600.

It will be seen from the foregoing description of the construction and operation of the linear assembly 10 and the selective opening sleeve positioner assembly 270 employed therewith that a number of advantages are provided thereby in the performance of open hole, multi-zone, gravel pack completions. One advantage of the system described and disclosed herein resides in the fact that the valve sleeves of the full opening collars and full opening packers are actuated solely by picking up and setting down the drill string upon which the sleeve positioner assembly 270 is mounted. This permits the operator to locate the collars and packers automatically, and further permits the application of substantially greater force to the valve sleeves if difficulty in their actuation is encoutered than can be applied to rotary valve mechanisms in the prior art collars and packers under similar circumstances.

As additional advantage inherent in the system disclosed herein resides in the fact that the full opening collar and full opening packer valve mechanisms can be placed in the closed position at the time of installation of the liner assembly 10 within the well bore 12. This permits the liner assembly to be floated into the well bore which substantially reduces the strain on the derrick, especially in deep wells. If the well bore 12 penetrates a high pressure formation which is being contained with mud to prevent blowout, the installation of a prior art liner assembly with necessarily open collar and packer valves substantially reduces the control available in containing the high pressure in the well bore, and could conceivably lead to an uncontained blowout since the liner assembly would be open at the top and would be provided with no means for containing such a blowout, whereas in the present system with the mud around the annulus between the closed liner assembly 10 and the well bore 12, a blowout could be contained by closing the blowout preventer rams at the ground surface.

Yet another advantage inherent in the present system is that the full opening packers employed in the liner assembly 10 are combined with the sleeve valve port collar mechanisms as an integral tool which is less expensive to manufacture and assemble than the combination of a separate packer and a separate port collar employed for the same purpose in prior art systems. Additionally, the full opening inflation packers employed in the present system utilize the differential pressure applied thereacross due to the column of cement or other fluids in the annulus above the inflated packer to feed back to the interior of the inflated packer past the annular check valve assembly to assure that the packer remains inflated. With certain prior art packers, the inflatable element is inflated from the bottom end. In the event a leak is encountered in the check valves in the bottom end of such packers, the differential pressure above the packer will force the inflating fluid out from under the packer thereby deflating and unseating the packer.

Changes may be made in the combination and arrangement of parts or elements as heretofore set forth in the specification and shown in the drawings without departing from the spirit and scope of the invention as defined in the following claims.

What is claimed is:

1. An operating tool for selectively actuating a sleeve valve of the type which includes:

a cylindrical housing having at least one port through the wall thereof; and a valve sleeve telescopically disposed within said housing and having at least one port through the wall thereof and adapted to communicate with the at least one port of the housing in a first open position and, alternately, sealed from communication with the at least one port of the housing in a second closed position, said operating tool comprising:

opening position means movable throgh said sleeve valve in the first open position in response to movement of said opening positioner means through said sleeve valve in a first direction, said opening positioner means including at least one outwardly biased arm adapted to selectively engage the valve sleeve of said sleeve valve; and selective activation means for selectively activating and deactivating said opening positioner means in response to manipulation of said operating too, said selective activation means including arm retractor means adapted to selectively engage said at least one arm for engaging and forcing said at least one arm inwardly against the bias thereof to a deactivated position whereby said opening positioner means can be moved through said sleeve valve in the first direction without placing said sleeve valve in the first open position and, alternately, for disengaging from said at least one arm and permitting said at least one arm to be moved outwardly in response to the bias thereof to an activated position whereby said opening positioner means can be moved throgh said sleeve valve in the first direction to thereby place said sleeve valve in the first open position.

2. The operating tool as defined in claim 1 characterized further to include:

closing positioner means movable through said sleeve valve for placing said sleeve valve in the second closed position in response to movement of said closing positioner means through said sleeve valve in a second direction.

3. The operating tool as defined in claim 2 characterized further to include:

a tubular member extending between said opening positioner means and said colsing positioner means and having at least one port through the wall thereof;

first annular seal means carried by said tubular member intermediate the at least one port thereof and said opening positioner means for isolating the at least one port of the valve sleeve from said opening positioner means; and second annular seal means carried by said tubular member intermediate the at least one port thereof and said closing positioner means for isolating the at least one port of the valve sleeve from said closing positioner means.

4. The operating tool as defined in claim 3 characterized further to include:

a passage in said tubular member extending from a position intermediate said first annular seal means and said opening positioner means to an opening in said tubular member to the side of said second annular seal means adjacent to said closing positioner means; and circulation valve means carried by said tubular member intermediate said first annular seal means and said opening positioner means for communicating said passage with the exterior of said tubular member and, alternately, sealing said passage from the exterior of said tubular member in response to manipulation of said tubular member.

5. An operating tool for selectively actuating a full opening gravel collar mounted in a tubing string from a position thereabove to alternately open and close the tubing string between the interior and exterior thereof, said gravel collar being of the type which includes:

an outer cylindrical housing having a plurality of ports through the wall thereof and adapted to be coaxially connected within the tubing string;

a valve sleeve telescopically disposed within the cylindrical housing and having a plurality of ports through the wall thereof, the ports being constructed and arranged to provide fluid communication therethrough to the ports of the cylindrical housing in a first position, and, alternately, being constructed and arranged to be sealed from fluid communication with the ports of the cylindrical housing in a second closed position;

spring tension means between the housing and the valve sleeve for yieldably retaining the valve sleeve against premature movement relative to the housing;

means for connecting the housing in coaxial alignment in a tubing string;

first detent means on the valve sleeve for receiving an operating force to telescopically move the valve sleeve relative to the housing to the first open position; and second detent means on the valve sleeve for receiving an operating force to telescopically move the valve sleeve relative to the housing to the second closed position;

said operating tool comprising:

an upper tubular member having an upper end portion and a lower end portion;

means for connecting the upper tubular member to a prime mover thereabove whereby the tubular member can be vertically reciprocated and rotated within the tubing string;

a lower tubular member having an upper end portion, a lower end portion and an intermediate portion;

means interconnecting the lower end portion of said upper tubular member and the upper end portion of said lower tubular member for providing mutual communication between the interiors of said upper and lower tubular members and preventing limited longitudinal relative movement therebetween and incremental rotational movement therebetween;

first passage means in said lower tubular member for providing fluid communication between the interior of the lower end portion of said upper tubular member and an opening to the exterior of the medial portion of said lower tubular member;

second passage means in said lower tubular member for providing fluid communication between an opening to the exterior of the lower end portion of said lower tubular member and an opening to the exterior of the upper end portion of said lower tubular member;

circulating valve means communication with the opeing to the exterior of the upper end portion of said lower tubular member for alternately opening and closing the opening to the exterior of the upper end portion of said lower tubular member in response to incremental rotational movement of said upper tubular member relative to said lower tubular member;

first annular seal means carried by said lower tubular member above the opening to the medial portion thereof for providing a seal between the exterior of said lower tubular member and the interior of said tubing string and the gravel collar mounted therein;

second annular seal means carried by said lower tubular member below the opening in the medial portion thereof for providing a seal between the exterior of said lower tubular member and the interior of said tubing string and the gravel collar mounted therein;

first positioner means mounted on said upper tubular member for engaging one of the detent means of the gravel collar valve sleeve to move the valve sleeve upwardly relative to the housing in response to an upward movement imparted to said upper tubular member;

second positioner means mounted on said lower tubular member below said second annular seal means for engaging the other of the detent means of the gravel collar valve sleeve to move the valve sleeve downwardly relative to the housing in response to a downward movement imparted to said lower tubular member; and selective activation means mounted adjacent said first positioner means for alternately permitting and preventing engagement of the one detent means by said first positioner means in response to manipulation of said upper tubular member.

6. The operating tool as defined in claim 5 characterized further to include:

means mounted on said lower tubular member for slidably frictionally engaging the interior of the tubing string to provide a predetermined restriction to longitudinal and rotational movement of said lower tubular member relative to said tubing string.

7. The operating tool as defined in claim 6 wherein:

said first positioner means includes at least one outwardly biased spring arm adapted to selectively engage one of the detent means of the gravel collar valve sleeve to move the valve sleeve upwardly relative to the housing in response to an upward movement imparted to said upper tubular member; and said selective activation means includes arm retractor means carried by said upper tubular member and adapted to selectively engage said at least one spring arm for engaging and enforcing said at least one spring arm inwardly against the bias thereof to a deactivated position whereby said first postioner means can be moved upwardly through the gravel collar without engaging one of the detent means of the valve sleeve thereof, and, alternately, for disengaging from said at least one spring arm and permitting said at least one spring arm to be moved outwardly in response to the bias thereof to an activated position whereby said first positioner means can be moved upwardly through the gravel collar to thereby engage one of the detent means of the gravel collar valve sleeve to thereby move the valve sleeve upwardly relative to the housing.

8. An operating tool for selectively actuating a full opening gravel collar mounted in a tubing string from a position thereabove to alternately open and close the tubing string between the interior and exterior thereof, said gravel collar being of the type which includes:

an outer cylindrical housing having a plurality of ports through the wall thereof and adapted to be coaxially connected in the tubing string;

a valve sleeve telescopically disposed within the cylindrical housing and having a plurality of ports through the wall thereof, the ports being adapted to provide fluid communication therethrough to the ports of the cylindrical housing in a first open position, and, alternately, being adapted to be sealed from fluid communication with the ports of the cylindrical housing in a second closed position;

spring tension means between the housing and the valve sleeve for yieldably retaining the valve sleeve against premature movement relative to the housing;

means for connecting the housing in coaxial alignment in a tubing string;

first detent means on the valve sleeve for receiving an operating force to telescopically move the valve sleeve relative to the housing to the first open position; and second detent means on the valve sleeve for receiving an operating port to telescopically move the valve sleeve relative to the housing to the second closed position;

said operating tool comprising:

an upper tubular member having an upper end portion and a lower end portion;

means for connecting the upper tubular member to a prime mover thereabove whereby the tubular member can be vertically reciprocated and rotated within the tubing string;

a lower tubular member having an upper end portion, a lower end portion and an intermediate portion;

means interconnecting the lower end portion of said upper tubular member and the upper end portion of said lower tubular member for providing mutual communication between the interiors of said upper and lower tubular members and permitting limited longitudinal relative movement therebetween and incremental rotational movement therebetween;

first passage means in said lower tubular member for providing fluid communication between the interior of the lower end portion of said upper tubular member and an opening to the exterior of the medial portion of said lower tubular member;

second passage means in said lower tubular member for providing fluid communication between an opening to the exterior of the lower end portion of said lower tubular member and an opening to the exterior of the upper end portion of said lower tubular member;

circulating valve means communicating with the opening to the exterior of the upper end portion of said lower tubular member for alternately opening and closing the opening to the exterior of the upper end portion of said lower tubular member in response to incremental rotational movement of said upper tubular member relative to said lower tubular member;

first annular seal means carried by said lower tubular member above the opening in the medial portion thereof for providing a seal between the exterior of said lower tubular member and the interior of said tubing string and the gravel collar mounted therein;

second annular seal means carried by said lower tubular member below the opening in the medial portion thereof for providing a seal between the exterior of said lower tubular member and the interior of said tubing string and the gravel collar mounted therein;

opening positioner means mounted on said upper tubular member for engaging the first detent means of the gravel collar valve sleeve to move the valve sleeve upwardly relative to the housing to the first open position in response to an upward movement imparted to said upper tubular member;

closing positioner means mounted on said lower tubular member below said second annular seal means for engaging the second detent means of the gravel collar valve sleeve to move the valve sleeve downwardly relative to the housing to the second closed position in response to a downward movement imparted to said lower tubular member; and selective activation means mounted adjacent said opening positioner means for alternately permitting and preventing engagement of the first detent means of the gravel collar valve sleeve by said opening positioner means in response to manipulation of said upper tubular member.

9. The operating tool as defined in claim 8 wherein:

said opening positioner means includes a plurality of outwardly biased spring arms adapted to selectively engage the first detent means on the gravel collar valve sleeve; and said selective activation means includes an activator collar movably telescopically disposed about said upper tubular member adjacent said opening positioner means and carrying retractor means thereon adapted to selectively engage said plurality of spring arms for engaging and forcing said spring arms inwardly against the bias thereof to a deactivated position whereby said opening positioner means can be moved upwardly through the gravel collar valve sleeve without engaging the first detent means thereof, and, alternately, for disengaging from said plurality of spring arms and permitting said spring arms to be moved outwardly in response to the bias thereof to an activated position whereby said opening positioner means can be moved upwardly through the gravel collar to thereby engage the first detent means of the gravel collar valve sleeve to telescopically move the valve sleeve relative to the housing to the first open position.

10. The oprating tool as defined in claim 9 wherein said selective activation means is characterized further to include:

means carried by said activator collar for providing sliding frictional engagement between said selective activation means and said tubing string to provide a predetermined restraint on longitudinal and rotational movement of said selective activation means in response to longitudinal and rotational movement of said upper tubular member; and J-slot means interconnecting said upper tubular member and said actuator collar whereby downward movement of said upper tubular member with right hand rotation thereof relative to said activator collar followed by upward movement of said upper tubular member relative to said activator collar disengages said retractor means from said plurality of spring arms to thereby place said spring arms in the activated position.

* * * * *